United States Patent [19]

Abe

[11] Patent Number: 4,889,026

[45] Date of Patent: Dec. 26, 1989

[54] SEQUENCER UNIT OF ELECTRONIC MUSICAL INSTRUMENT

[75] Inventor: Yasunao Abe, Hamamatsu, Japan

[73] Assignee: Yamaha Corporation, Hamamatsu, Japan

[21] Appl. No.: 199,363

[22] Filed: May 26, 1988

[30] Foreign Application Priority Data

May 29, 1987 [JP] Japan ..... 62-131081
May 29, 1987 [JP] Japan ..... 62-131080
May 29, 1987 [JP] Japan ..... 62-131079
May 29, 1987 [JP] Japan ..... 62-131082

[51] Int. Cl.[4] ..... G10H 1/38; G10H 1/40; G10H 7/00

[52] U.S. Cl. ..... 84/611; 84/DIG. 12; 84/DIG. 22

[58] Field of Search ..... 84/1.01, 1.03, 1.28, 84/DIG. 12, DIG. 22, DIG. 29

[56] References Cited

U.S. PATENT DOCUMENTS 4,062,263 12/1977 Yamaga et al. ..... 84/1.03
4,662,262 5/1987 Matsumoto ..... 84/1.03

FOREIGN PATENT DOCUMENTS 53-70421 6/1978 Japan .
61-174599 8/1986 Japan .

*Primary Examiner*—Stanley J. Witkowski
*Attorney, Agent, or Firm*—Spensley Horn Jubas & Lubitz

[57] ABSTRACT

A sequencer unit of electronic musical instrument including a plurality of sequencers each storing specific performance data which are generated by operating a keyboard in advance. In the case where an automatic performance is played based on first performance data of selected one sequencer and then second performance data of another sequencer are selected, the first performance data are smoothly changed over to the second performance data and then the automatic performance is played based on the second performance data at a desirable timing which can be arbitrarily determined. Even when the ending timing of performance data to be written in the sequencer does not match with the end of bar, the length of performance data read from the sequencer can be easily adjusted to predetermined bars. Further, it is possible to easily adjust a break period in which the automatic performance is broken so that keyboard performance can be played.

20 Claims, 17 Drawing Sheets

(EVENT DATA FORMATS)

(STATE TRANSITION DIAGRAM)

(NORMAL MODE PROCESS)

(NORMAL MODE PROCESS)

(CHORD DETECTION PROCESS)

(SYNCHRO STANDBY MODE PROCESS)

(SYNCHRO STANDBY MODE PROCESS)

(RUN MODE & BREAK RUN MODE PROCESS)

(RUN MODE & BREAK RUN MODE PROCESS)

(BREAK MODE PROCESS)

(ENDING MODE PROCESS)

(CLOCK INTERRUPT PROCESS)

SEQ READ
500
(CLK.MOD.4) =0?
502
NO
YES
RET
READ FIRST
800
SEQN (ADRS) = 00H ?
511
NO
YES
SEQMOD ⇐ 0
MOD ⇐ 0
512
MDFLG ⇐ 1
513
RET
SEQN (ADRS) = 80H−BAR x 8 + CLK/4 ?
521
NO
RET
YES
H
I
(SEQUENCER READING PROCESS)

G
CLK ⇐ CLK + 1
321
CLK = 32 ?
323
NO
YES
CLK ⇐ 0
324
SEQMOD=1OR2?
325
NO
YES
BAR ⇐ BAR + 1
326
BARCLK ⇐ 3 − BARCLK
327
MDFLG= 1 ?
328
NO
RET
YES
MODE = ?
329
0
1
2
3
4
TO NORMAL
100
TO SYNCHRO
170
TO RUN
200
TO BREAK
250
TO ENDING
280
(CLOCK INTERRUPT PROCESS)

(SEQUENCER READING PROCESS)

(READ FIRST PROCESS)

(READ LAST PROCESS)

(CHORD CHECK PROCESS)

(SEQUENCER CHECK PROCESS)

(FILL–IN CHECK PROCESS)

(ENDING CHECK PROCESS)

(BREAK CANCEL PROCESS)

(ENDING CANCEL PROCESS)

(SEQUENCER WRITING PROCESS)

(SEQUENCER WRITING PROCESS)

(SEQUENCER CHANGE-OVER STATE)

(FILL-IN CHANGE-OVER STATE)

(BREAK TRANSFER STATE)

(RELATION BETWEEN SEQUENCER WRITE DATA AND REPRODUCING STATE)

SEQUENCER UNIT OF ELECTRONIC MUSICAL INSTRUMENT

BACKGROUND OF THE INVENTION

1. Field of the Invention

The present invention relates to a sequencer unit of electronic musical instrument, and more particularly to a sequencer unit of electronic musical instrument in which a plurality of sequencers can be changed over in response to a player's will with ease.

2. Prior Art

As an additional unit for automatically playing a performance in the electronic musical instrument, a sequencer unit is well known as disclosed in Japanese Patent Laid-Open Publication No. Sho 61-174599 (entitled: "Performance Data Processing Apparatus"), U.S. Pat. No. 4,062,263 (entitled: "Automatic Rhythm Performing Apparatus") and Japanese Patent Laid-Open Publication No. Sho 53-70421 (entitled: "Automatic Accompaniment Apparatus"), all of which were filed by the present applicant, for example. The above performance data processing apparatus is a chord sequencer by which chord data are written in and read from the memory so as to output data changed in response to a predetermined accompaniment pattern, and the read data are used as automatic accompaniment data for the electronic musical instrument, for example. In addition, the above automatic accompaniment apparatus automatically plays a rhythm performance having a desirable rhythm pattern when the main performance is ended.

In the conventional techniques described above, a plurality of sequencers (or memory means) are provided. However, the conventional techniques do not refer to operations thereof when the sequencers are changed over. In the chord sequencer which records (or writes in) and reproduces the chord data as the performance data, two or more bars are frequently repeatedly performed (i.e., repeat reproduction is frequently executed). Meanwhile in the case where the writing is ended at a certain timing in a sequencer writing cycle in the conventional chord sequencer, the music is reproduced till the certain timing and then the reading returns back to head data. For this reason, the certain timing is not synchronized with the bar, so that the notes must be shifted at every time when the reproduction is repeated. Thus, the conventional chord sequencer suffers a disadvantage in that the player must pay great attention to the timing of depressing a writing end switch.

On the other hand, in the conventional automatic rhythm performance apparatus, it is not possible to take a break (i.e., a non-rhythm state) having an arbitrary period in the rhythm performance. In order to take such a break, it is possible to adopt a method in which a rhythm start switch is operated to thereby temporarily stop generating the rhythm and then the rhythm is restarted at an arbitrary timing as disclosed in the Japanese Patent Publication No. Sho 59-31077. At re-starting, a tempo clock must be reset, and the conventional automatic rhythm performance apparatus suffers a disadvantage in that a timing of section must be shifted in the re-started rhythm.

Hereinafter, the word "section" will be defined by a quarter period of one bar of 4/4 time, or one third period of one bar of ¾ time, for example. In other words, there are four sections, i.e., first to fourth sections in one bar of 4/4 time, and there are three sections, i.e., first to third sections in one bar of ¾ time.

By combining the above three conventional techniques together, it is possible to design so that the accompaniment pattern will be changed to the desirable ending pattern at the ending timing thereof. When the ending pattern is selected as the chord read from the chord sequencer changes "C", "Em" to "D7", the accompaniment chord must be changed "C", "Em" to "D7" similarly. Such phenomenon is not preferable.

SUMMARY OF THE INVENTION

It is a primary object of the present invention to provide a sequencer unit of electronic musical instrument in which plural sequencers can be changed over in response to the player's will with ease.

It is another object of the present invention to provide a sequencer unit of electronic musical instrument which can perform the music by the predetermined timing (i.e., by the bar) repeatedly even when the writing end timing is deviated in the writing cycle.

It is still another object of the present invention to provide a sequencer unit of electronic musical instrument which can arbitrarily set the period of break while the rhythm is automatically performed.

It is a further object of the present invention to provide a sequencer unit of electronic musical instrument which can complete the accompaniment by the chord and pattern which are suitable for the ending of musical tune when the ending is selected within the sequencer performance.

In a first aspect of the invention, there is provided a sequencer unit of electronic musical instrument comprising:

(a) rhythm tone generating means for generating a rhythm tone;

(b) start commanding means for giving a start command to the rhythm tone generating means to thereby start generating the rhythm tone;

(c) stop commanding means for giving a stop command to the rhythm tone generating means to thereby stop generating the rhythm tone; and (d) rhythm tone control means for controlling the rhythm tone generating means not to generate the rhythm tone with the rhythm progressing during the time of the stop command and the start command when the start command is given before a predetermined time has passed since the stop command has been given, while the rhythm tone control means controls the rhythm tone generating means to generate the rhythm tone from an initial state when the start command is given after the predetermined time has passed since the stop command has been given.

In a second aspect of the invention, there is provided a sequencer unit for electronic musical instrument comprising:

(a) memory means containing a plurality of memories each storing performance data;

(b) select means for selecting one of the plurality of memories;

(c) means for generating a tempo clock;

(d) reading means for sequentially reading out the performance data from the memory means based on the tempo clock; and (e) reading control means for changing over the memory to be read out at a timing corresponding to a timing for selecting another memory when the select means selects the another memory while the select means selects one memory so that the reading means reads out the performance data from the one memory.

In a third aspect of the invention, there is provided a sequencer unit for electronic musical instrument comprising:

(a) memory means for storing performance data;

(b) writing means for writing the performance data into the memory means;

(c) means for generating a tempo clock; and .

(d) reading means for sequentially reading out the performance data from the memory means based on the tempo clock, the reading means reading out the performance data in accordance with a predetermined order corresponding to an end timing for writing the performance data into the memory means when the last of the performance data written in the memory means is located in the middle of bar.

In a fourth aspect of the invention, there is provided an electronic musical instrument comprising:

(a) memory means for storing performance data;

(b) means for generating a tempo clock;

(c) reading means for sequentially reading out the performance data from the memory means based on the tempo clock;

(d) musical tone generating means for generating a musical tone in response to read performance data;

(e) a first switch for changing a performance state from an automatic performance state to a non-performance state;

(f) a second switch for re-starting the automatic performance in the non-performance state; and (g) control means for inhibiting a generation of musical tone without stopping a generation of the tempo clock and a counting operation after a time when the control means detects that the first switch is operated, while the control means allows the generation of musical tone after a time when the control means detects that the second switch is operated.

In a fifth aspect of the invention, there is provided a sequencer unit of electronic musical instrument comprising:

(a) first memory means for storing chord data;

(b) second memory means for storing a plurality of accompaniment patterns including an ending pattern;

(c) means for selecting one of the accompaniment patterns;

(d) means for generating a tempo clock;

(e) reading means for sequentially reading out stored data from the first and second memory means based on the tempo clock; and (f) accompaniment data generating means for generating and outputting accompaniment data based on the chord data and the accompaniment pattern, the accompaniment data generating means limiting a change of the chord data when the ending pattern is selected.

In a sixth aspect of the invention, there is provided an electronic musical instrument comprising:

(a) control means;

(b) a tempo generator for generating a clock pulse corresponding to a predetermined tempo;

(c) a sequencer memory including a plurality of sequencer areas each storing specific performance data which are generated in accordance with a performance of keyboard in advance, the performance data being written in and read from each sequencer area in synchronism with the clock pulse;

(d) register means including a plurality of registers each writing and reading out specific data under control of the control means; and (e) switching means including a plurality of switches each controlling an automatic performance which is played based on the performance data stored in the sequencer memory.

BRIEF DESCRIPTION OF THE DRAWINGS

Further objects and advantages of the present invention will be apparent from the following description, reference being had to the accompanying drawings wherein a preferred embodiment of the present invention are clearly shown.

In the drawings.

DESCRIPTION OF THE PREFERRED EMBODIMENT

Figure 1:
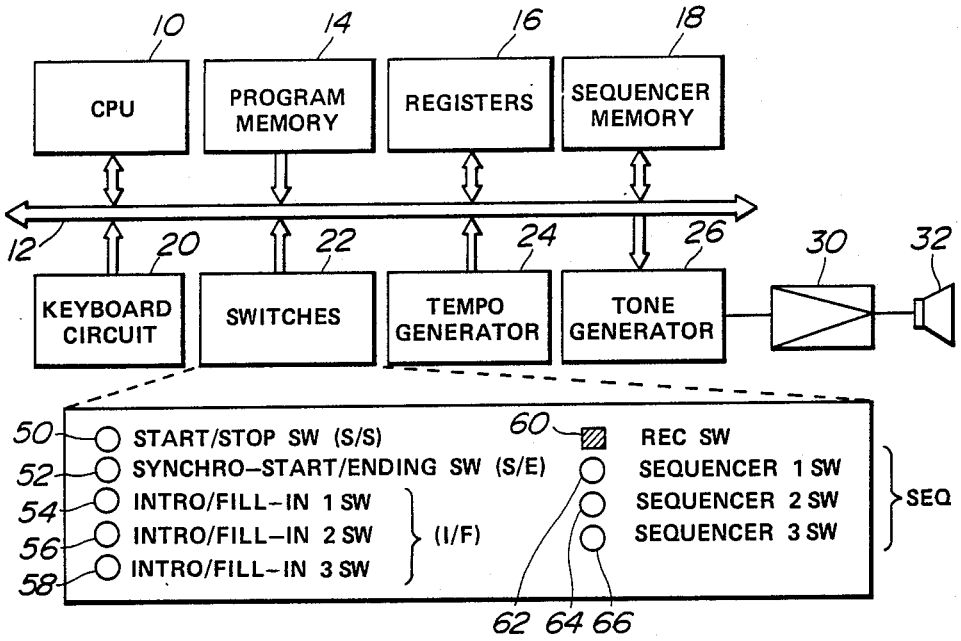
FIG. 1 is a block diagram showing a hardware constitution of electronic musical instrument adopting a sequencer unit according to an embodiment of present invention.

Referring now to the drawings, wherein like reference characters designate like or corresponding parts throughout the several views, FIG. 1 is a block diagram showing a hardware constitution of electronic musical instrument adopting a sequencer unit according to an embodiment of present invention.

[DESCRIPTION OF CONSTITUTION OF ELECTRONIC MUSICAL INSTRUMENT SHOWN IN FIG. 1]

In FIG. 1, a central processing unit (CPU) 10 is provided for controlling whole operations of electronic musical instrument. This CPU 10 is connected to a program memory 14, registers 16, a sequencer memory 18, a keyboard circuit 20, switches 22, a tempo generator 24 and a tone generator 26 via a bi-directional bus line 12. The tone generator 26 is connected to an amplifier 30 for driving a speaker 32.

The program memory 14 is constituted by a read only memory (ROM) etc. to thereby store control programs for the CPU 10.

The registers 16 are provided for temporarily storing several kinds of data which are produced when the CPU 10 executes the above-mentioned control programs. Each register within the registers 16 is arranged at each predetermined area within a random access memory (RAM), for example.

The following symbols represent the registers constituting the registers 16 in alphabetical order. Incidentally, each of the following symbols designates content of data for each register if there is no special comment described therein.

1. ADRS: address pointer used for read/write of sequencers SEQ1 to SEQ3.
2. BARCLK: counter which takes value "1" or "2" at each bar alternatively.
3. BAR: register the data of which represents a number of bars from a preceding sequencer event.
4. BEAT: beat where the sequencer event exists (the value range of "0" to "7"; eighth note resolution).
5. CLK: tempo clock (the value thereof takes "0" to "31").
6. END: register the value of which becomes "1" in synchronism with the tempo clock CLK when an ending switch is "ON".
7. ENDCOD: flag which determines whether a sequencer end command ($00_H$) is written in or not.
8. EVT: event data in a sequencer write cycle.
9. MODE: operation mode (0: normal, 1: synchro, 2: run, 3: break, 4: ending).
10. MDFLG: flag the value of which becomes "1" when the mode is changed in a tempo interrupt cycle.
11. ROOT: root tone of chord (the value thereof takes "1" to "12").
12. TYPE: chord kind (the value thereof takes "0" to "7").
13. OLDBT: value of preceding BEAT.
14. QNT: quantization in write cycle; thirty-two resolution for CLK; eight resolution for BEAT.
15. SEQMOD: sequencer mode (0: no sequencer, 1: sequencer play (reproduction), 2: sequencer record (write))
16. SEQL: lower four bits of sequencer data which are to be read out.
17. TIM: timing data for event data in a sequencer write cycle.
18. TROOT, TTYPE, TSEQ, TFIL, TEND: registers each changing the value thereof when a key of keyboard circuit 20 or each switch within the switches 22 is depressed.

Figures 2A, 2B, 2C:
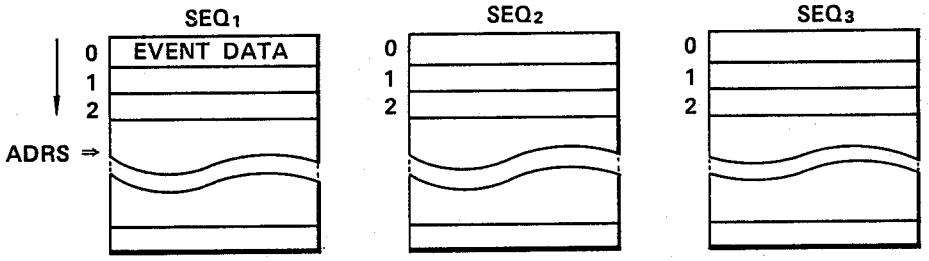
FIGS. 2A to 2C are diagrams each showing a data arrangement of a sequencer memory shown in FIG. 1.
Figure 3:
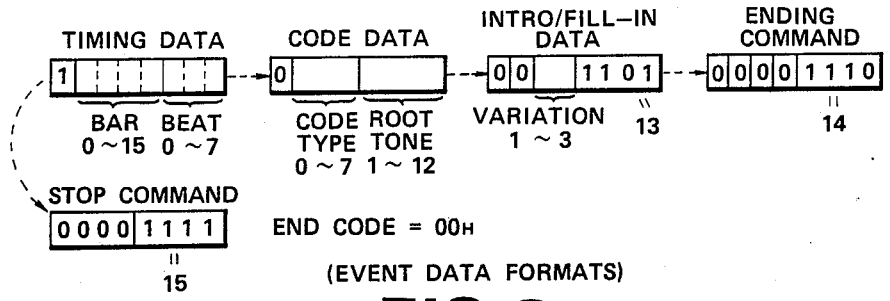
FIG. 3 is a diagram showing event data formats of the sequencer memory shown in FIG. 1.

The sequencer memory 18 is constituted by RAM, for example. As shown in FIGS. 2A to 2C, areas of three sequencers SEQ1 to SEQ3 are provided in the sequencer memory 18. Each of these sequencers SEQ1 to SEQ3 stores several kinds of event data having formats such as "timing data", "chord data", "intro/fill-in data", "ending command" and "stop command" as shown in FIG. 3.

The data having the first bit (i.e., most significant bit; MS)) of "1" are the timing data. Such timing data indicate the number of bars from the bar where a preceding event occurs and the event occurring timing within the bar. More specifically, the value of second to fifth bits (i.e., the decimal value of "0" to "15") represents the number of bars, and the value of sixth to eighth bits (i.e., the decimal value of "0" to "7") represents the timing (or the number of beats) within the bar.

In the chord data, the MSB is "0" and the decimal value of the lower four bits varies from "1" to "12". In such chord data, the value of the upper four bits (which ranges from 0 to 7) represents a chord type (or a chord kind), and the value of lower four bits (which ranges from "1" to "12") represents the root tone.

In the intro/fill-in data, the MSB is "0" and the decimal value of lower four bits is "13". In such intro/fill-in data, the decimal value of upper four bits (which takes "1" to "3") represents a variation kind.

The data of eight bits designate the ending command or the stop command when the decimal value of upper four bits is "0". More specifically, the decimal value of lower four bits equal to "14" in the ending command, while the decimal value of lower four bits equal to "15" in the stop command.

The keyboard circuit 20 provides many key switches (not shown) each corresponding to each key of keyboard. This keyboard circuit 20 generates key event data representative of a key-depression, a key-release and a key name when the key event is occurred due to the keyboard operation.

As shown in FIG. 1, the switches 22 include a start/stop (S/S) switch 50, a synchro-start/ending (S/E) switch 52, intro/fill-in pattern selection (I/F) switches 54 to 58, a recording (REC) switch 60, and sequencer selection (SEQ) switches 62 to 66 and other switches.

The tempo generator 24 is constituted by a variable frequency oscillator or a combination of a fixed frequency oscillator and a divider having variable dividing rate so that the tempo generator 24 can generate a clock pulse in response to a preset tempo.

The tone generator 26 generates a musical tone signal based on data supplied from the CPU 10, and such data represents the key-depression, the key-release, a tone color (or a kind of musical instrument) and a tone pitch and the like. The musical tone signal is supplied to the amplifier 30, wherein the musical tone signal is amplified. The speaker 32 is driven by the amplifier 30, so that a musical tone is generated from the speaker 32.

[DESCRIPTION OF FUNCTIONS AND OPERATIONS OF ELECTRONIC MUSICAL INSTRUMENT SHOWN IN FIG. 1]

Figure 4:
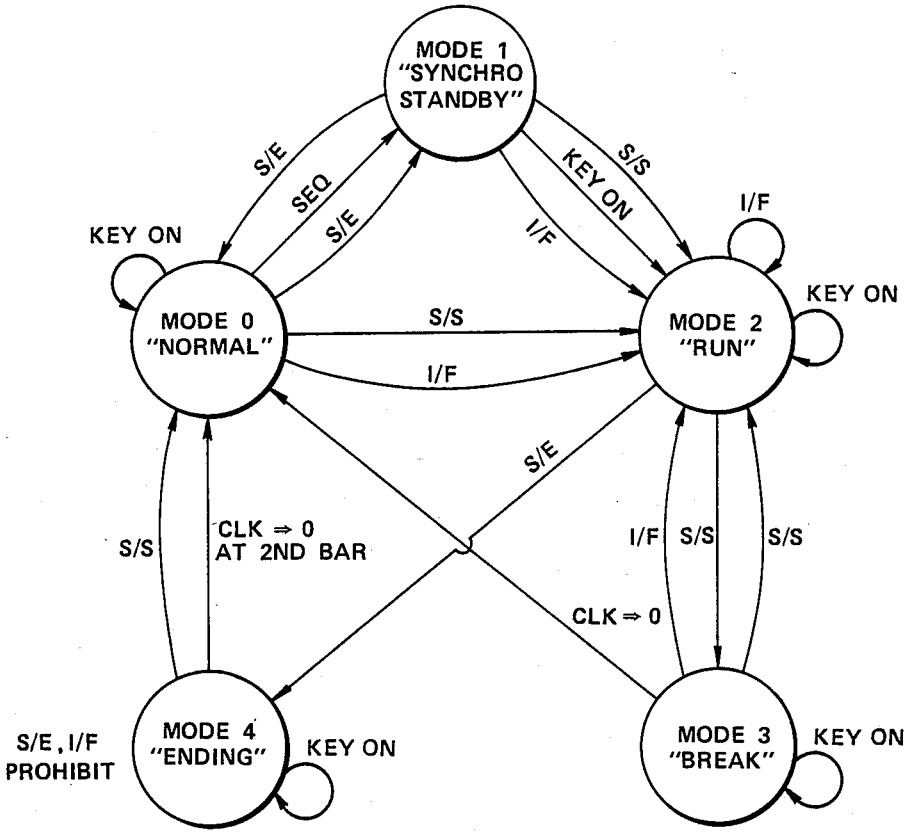
FIG. 4 is a state transition diagram of electronic musical instrument.

FIG. 4 is a state transition diagram of the electronic musical instrument shown in FIG. 1. This electronic musical instrument provides an auto rhythm function for automatically performing the rhythm and a function for recording and reproducing the accompaniment tones other than the performance mode as the normal keyboard musical instrument.

In FIG. 4, a "normal" mode is the mode for playing the keyboard performance without automatically performing the rhythm and the accompaniment. When the keyboard is operated in this normal mode, the musical tune corresponding to such (key-on) operation is generated. When the S/E switch 52 or one of the SEQ switches 62 to 66 is turned on in the normal mode, the mode is transited to a "synchro standby" mode. On the other hand, when the S/S switch 50 or one of the I/F switches 54 to 58 is turned on in the normal mode, the mode is transited to a "run (i.e., automatic rhythm performance)" mode.

The synchro standby mode is the mode for starting the automatic rhythm performance in synchronism with the keyboard performance. When the keyboard is operated or when the S/S switch 50 or one of the I/F switches 54 to 58 is turned on in this synchro standby mode, the mode is transited to the run mode.

The run mode is the mode for playing the keyboard performance with automatically performing the rhythm. The mode is transited to a "break" mode when the S/S switch 50 is turned on in the run mode, while the mode is transited to an "ending" mode when the S/E switch 52 is turned on in the run mode.

The break mode is the mode for breaking the automatic rhythm performance and then playing the keyboard performance. In the present embodiment, the tempo clock counter CLK must be advanced while the automatic rhythm performance is broken. When one of the I/F switches 54 to 58 is turned on in this break mode, the mode is transited to the run mode. In this case, the automatic rhythm performance of fill-in pattern corresponding to the "ON" switch is re-started at a timing of section just before the mode is transited to the break mode. In the break mode, the mode can be transited to the run mode by turning the S/S switch 50 on. In this case, the counter CLK must be reset, hence, the automatic rhythm performance must be started from the initial timing so that the timing of section will not be matched in some cases. Further, after the mode is transited to this break mode, the mode must be transited to the normal mode when the counter CLK counts the value corresponding to the ending point of the bar (i.e., CLK=0). In short, the automatic rhythm performance will be stopped in this case.

The ending mode is the mode for stopping the automatic performance after automatically performing the rhythm and accompaniment pattern of two bars corresponding to the ending part of tune. When the second bar within the above two bars is completely performed (i.e., the state is changed from BARCLK=2 to CLK=0) in this ending mode, the mode is transited to the normal mode (in other words, an automatic performance stopping mode). In addition, when the S/S switch 50 is turned on in the ending mode, the mode is transited to the normal mode. In this ending mode, the turn-on operations of the S/E switch 52 and the I/F switches 54 to 58 are neglected.

Further, the mode is changed to a "sequencer play" mode in the electronic musical instrument shown in FIG. 1 when one of the SEQ switches 62 to 66 is turned on, which is not shown in FIG. 4. In addition, when the REC switch 60 and one of the SEQ switches 62 to 66 are turned on together at the same time, the mode is changed to a "sequencer recording" mode. Hereinafter, a "sequencer" mode will represent both of the sequencer play mode and sequencer recording mode.

Each sequencer mode can be "ON" in any of the normal mode, the synchro standby mode, the run mode, the break mode and the ending mode. However, the sequencer can not be changed over in the sequencer recording mode. In addition, when any of the SEQ switches 62 to 66 for setting the sequencer mode are turned on in the normal mode, the mode is transited to the synchro standby mode as described before.

The sequencer play mode is the mode for automatically performing the accompaniment and rhythm together in the run mode.

The sequencer recording mode is the mode for writing accompaniment data into the sequencer memory 18 by real time in the run mode.

When the run mode is selected without turning the sequencer mode on, the rhythm is only automatically performed.

[DESCRIPTION OF OPERATIONS OF ELECTRONIC MUSICAL INSTRUMENT SHOWN IN FIG. 1]

Next, description will be given with respect to the operations of the electronic musical instrument shown in FIG. 1 in conjunction with flowcharts shown in FIGS. 5A to 21B.

When the power is applied to this electronic musical instrument, the CPU 10 starts the operations in accordance with the control programs stored in the program memory 12. First, the CPU 10 executes a normal mode process described by the step 100 and the following steps shown in FIGS. 5A and 5B.

(1) Normal Mode Process

Figures 5A, 5B:
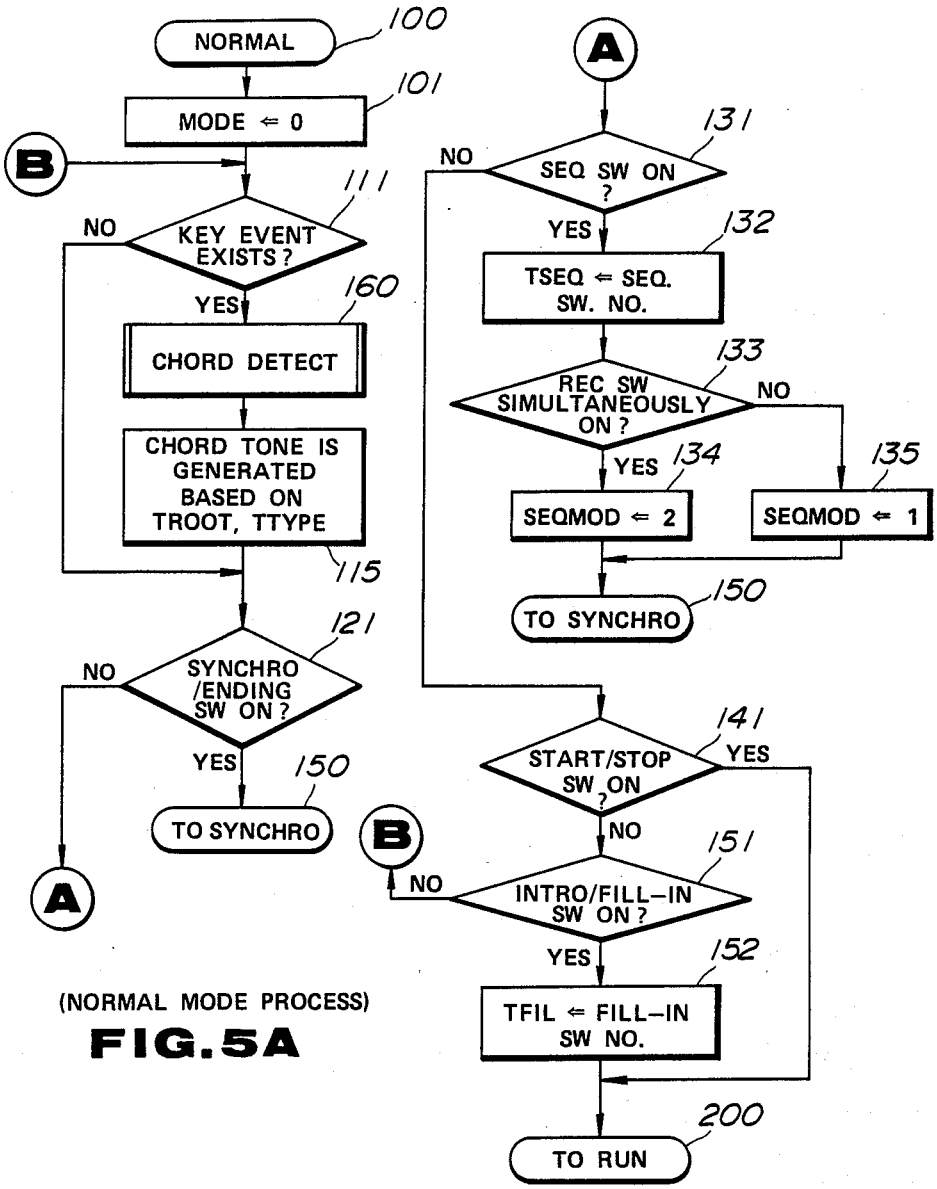
FIGS. 5A and 5B are flowcharts showing a normal mode process.

In FIG. 5A, the data "0" representative of the normal mode are stored in the mode register MODE. Next, the CPU 10 sequentially scans the output of keyboard circuit 20 and the operating states of the S/S switch, the S/E switch 52, the I/F switches 54 to 58 and the SEQ switches 62 to 66 in steps 111, 121, 131, 141 and 151. When the event of keyboard or the events of any of these switches are detected in these steps, the CPU 10 executes the process corresponding to the detected event.

Figure 6:
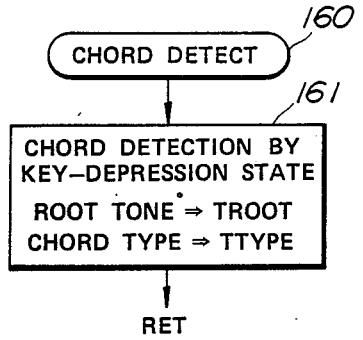
FIG. 6 is a flowchart showing a chord detection process.

More specifically, in the case where the CPU 10 detects key event data from the keyboard circuit 20 due to the keyboard operation in the step 111, the CPU 10 detects the chord based on the key-depression state of keyboard in a step 160 of chord detection process (shown in FIG. 6). The root tone and chord type of the detected chord are respectively stored in the registers TROOT and TTYPE. In a next step 115, such data TROOT and TTYPE are transmitted to the tone generator 26 so that the detected chord tone will be generated, and then the processing proceeds to the step 121. On the contrary, when the key event data cannot be detected in the step 111, the processing directly proceeds to the step 121 from the step 111.

In the step 121, the CPU 10 examines the S/E switch 52. When the S/E switch 52 is turned on, the processing proceeds to a step 170 of synchro standby mode process (shown in FIG. 7A) via a step 150. When the S/E switch 52 is not turned on, the processing proceeds to the step 131 shown in FIG. 5B.

In the step 131, the CPU 10 examines the SEQ switches 62 to 66. If any one of the SEQ switches 62 to 66 is turned on, the number ("1" to "3") of "ON" SEQ switch is stored in the register TSEQ in a step 132. Thereafter, the CPU 10 judges whether the REC switch 60 is also turned on at this time or not in a step 133. If the REC switch 60 is turned on at this time, data "2" representative of the sequencer recording mode are stored in the sequencer mode register SEQMOD in a step 134. If not, data "1" representative of the sequencer play mode are stored in the sequencer mode register SEQMOD in a step 135. Thereafter, the processing proceeds to the step 170 of synchro standby mode (shown in FIG. 7A) via the step 150. On the other hand, when the step 131 detects that any one of the SEQ switches 62 to 66 is not turned on, the CPU 10 examines the S/S switch 50 in the next step 141.

Figure 8A:
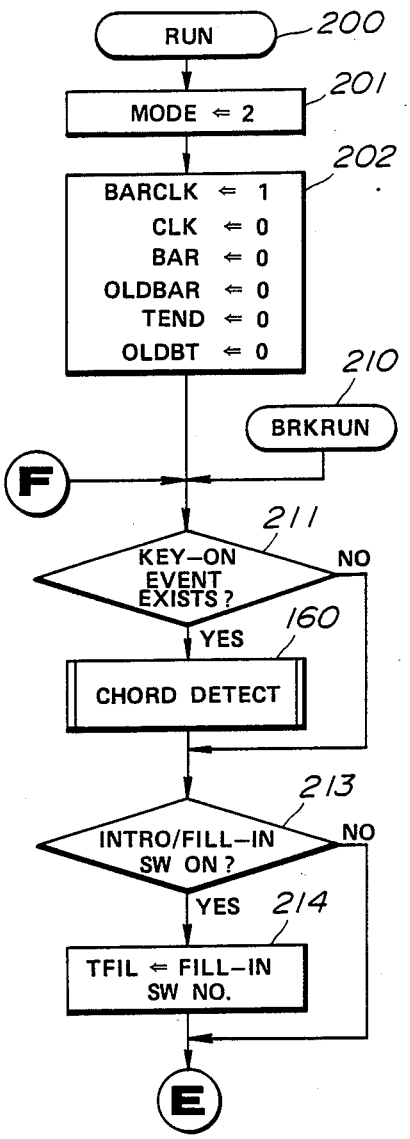
FIGS. 8A and 8B are flowcharts showing a run mode process.

When the CPU 10 detects that the S/S switch 50 is turned on in the step 141, the processing proceeds to a step 200 of run mode process (i.e., the automatic performance mode process) (shown in FIG. 8A). When the switch 50 is not turned on, the processing proceeds to the step 151.

In the step 151, the CPU 10 examines the I/F switches 54 to 58. When any one of the I/F switches 54 to 58 is turned on, the number ("1" to "3") of "ON" I/F switch is stored in the register TFIL in a step 152, and thereafter, the processing proceeds to the step 200 of run mode process (shown in FIG. 8A). On the contrary, when any one of the I/F switches 54 to 58 is not turned on, the processing returns back to the step 111 from the step 151.

(2) Synchro Standby Mode Process

Figure 7A:
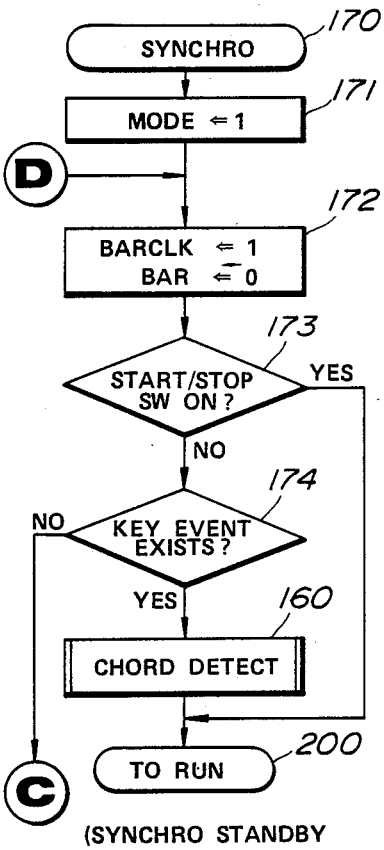
FIGS. 7A and 7B are flowcharts showing a synchro standby mode process.
Figure 7B:
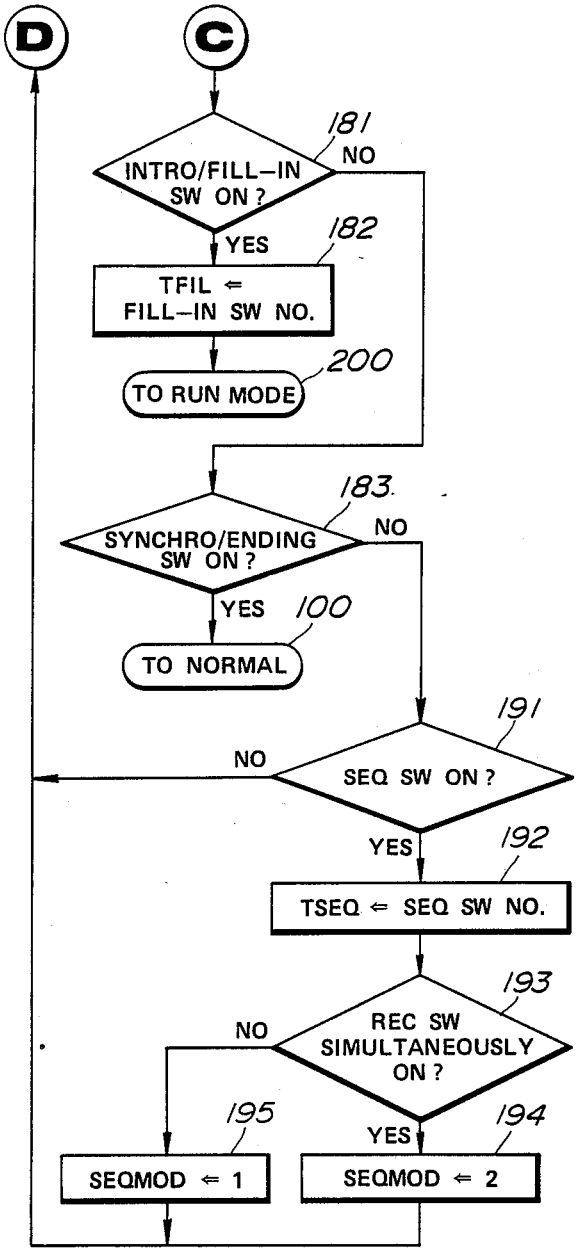

In FIG. 7A, data "1" representative of the synchro standby mode are stored in the mode register MODE in a step 171. Next, data "1" are stored in the bar number register BARCLK and the bar number register BAR is cleared in a step 172. Thereafter, the CPU 10 sequentially scans the S/S switch 50, the output of keyboard circuit 20, the I/F switches 54 to 58, the S/E switch 52 and the SEQ switches 62 to 66 in steps 173, 174, 181, 183 and 191.

When the step 173 detects that the S/S switch 50 is turned on, the processing proceeds to the step 200 of run mode process (shown in FIG. 8A). When the S/S switch 50 is not turned on, the processing proceeds to the step 174.

When the CPU 10 detects the key event data in the step 174, the processing proceeds to steps 160 and 161 (shown in FIG. 6), wherein the chord is detected based on the key-depression state, and then the root tone and chord type of the detected chord are respectively stored in the registers TROOT and TTYPE. Thereafter, the processing proceeds to the step 200 of run mode process (shown in FIG. 8A). On the contrary, when the key event data are not detected in the step 174, the processing proceeds to the step 181 shown in FIG. 7B.

In the step 181, the CPU 10 examines the I/F switches 54 to 58. When any one of the I/F switches 54 to 58 is turned on, the number ("1" to "3") of "ON" I/F switch is stored in the register TFIL in a step 182, and thereafter, the processing proceeds to the step 200 of run mode process (shown in FIG. 8A). On the contrary, when any one of the I/F switches 54 to 58 is not turned on at all, the processing proceeds to a step 183.

In the step 183, the CPU 10 examines the S/E switch 52. When the S/E switch 52 is turned on, the processing proceeds to the step 100 of normal mode process (shown in FIG. 5A). When the S/E switch 52 is not turned on, the processing proceeds to a step 191.

In the step 191, the CPU 10 examines the SEQ switches 62 to 66. When any one of the SEQ switches 62 to 66 is not turned on at all, the processing directly returns to the step 172. When any one of the SEQ switches 62 to 66 is turned on, the number ("1" to "3") of "ON" SEQ switch is stored in the register TSEQ in a step 192. Thereafter, it is judged whether the REC switch 60 is simultaneously turned on at this time or not in a step 193. If the REC switch 60 is turned on at this time, data "2" representative of the sequencer recording mode are stored in the sequencer mode register SEQMOD in a step 194. If not, data "1" representative of the sequencer play mode are stored in the sequencer mode register SEQMOD in a step 195. After executing one of the steps 194 and 195, the processing returns back to the step 172 shown in FIG. 7A.

(3) Run Mode Process

Figure 8B:
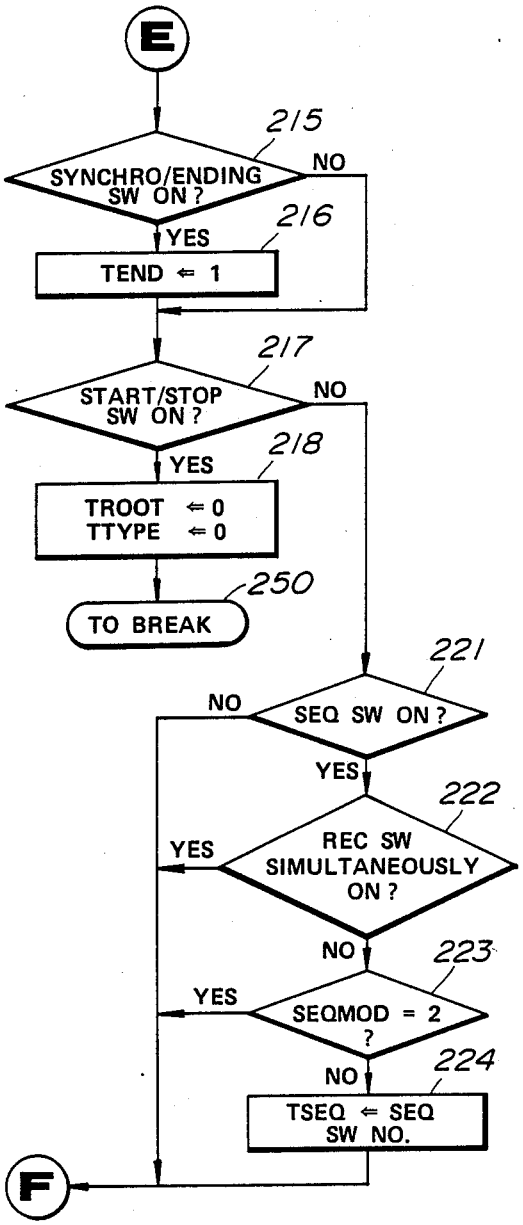

Referring to FIGS. 8A and 8B, data "2" representative of the run mode are stored in the mode register MODE in a first step 201. In a next step 202, value "1" is set as the bar number BARCLK, and the tempo clock CLK, the bar number BAR, the old bar number OLDBAR, the register TEND and the old beat number OLDBT are all cleared. Thereafter, it is judged whether any key event exists or not in a step 211.

When the step 211 judges that there is any key event existed, the chord is detected by the key-depression state, and then the root tone and chord type of the detected chord are respectively stored in the registers TROOT and TTYPE in steps 160 and 161 (shown in FIG. 6). Thereafter, the processing proceeds to a step 213. On the contrary, when the step 211 judges that there is no key event existed, the processing directly proceeds to the step 213 from the step 211.

In the step 213, the CPU 10 examines the I/F switches 54 to 58. When any one of the I/F switches 54 to 58 is turned on, the number ("1" to "3") of "ON" I/F switch is stored in the register TFIL in a step 214, and thereafter, the processing proceeds to a step 215 shown in FIG. 8B. When any one of the I/F switches 54 to 58 is not turned on at all, the processing directly proceeds to the step 215 from the step 213.

In the step 215, the CPU 10 examines the S/E switch 52. When the S/E switch 52 is turned on, data "1" representative of the ending are stored in the register TEND in a step 216, and then the processing proceeds to a step 217. On the other hand, when the S/E switch 52 is not turned on, the processing directly proceeds to the step 217 from the step 215.

In the step 217, the S/S switch 50 is examined. When the S/S switch 50 is turned on, the above-mentioned registers TROOT and TTYPE are both cleared in a step 218. Thereafter, the processing proceeds to a step 250 of break mode process shown in FIG. 9. On the other hand, when the S/S switch 50 is not turned on, the processing proceeds to a step 221 from the step 217.

In the step 221, the SEQ switches 62 to 66 are examined. When any one of the SEQ switches 62 to 66 is not turned on, the processing directly returns to the step 211 (shown in FIG. 8A) from the step 221. On the other hand, when any one of the SEQ switches 62 to 66 is turned on, it is judged whether the REC switch 60 is simultaneously turned on at this time or not in a next step 222. When the REC switch 60 is simultaneously turned on, the processing directly returns to the step 211 from the step 222. When the REC switch 60 is not simultaneously turned on, it is further judged whether the sequencer mode SEQMOD represents the writing (i.e., the value of the mode SEQMOD equals to "2") or not in a step 223. If the mode SEQMOD does not represent the sequencer recording mode (i.e., the value "2"), the number ("1" to "3") of "ON" SEQ switch is stored in the register TSEQ in a step 224, and then the processing returns to the step 211. On the other hand, if the mode SEQMOD represents the sequencer recording mode, the processing directly returns to the step 211 from the step 223.

Due to the processes of these steps 221 to 224, in the case where any one of the SEQ switches 62 to 66 is operated in the run mode, the CPU 10 can allow the change-over from "sequencer off mode" to "sequencer play mode" and the change-over of sequencers in the sequencer play cycle. On the contrary, the CPU 10 inhibits the change-over to sequencer recording mode and the change-over of sequencers in the sequencer recording cycle.

(4) Break Mode Process

Figure 9:
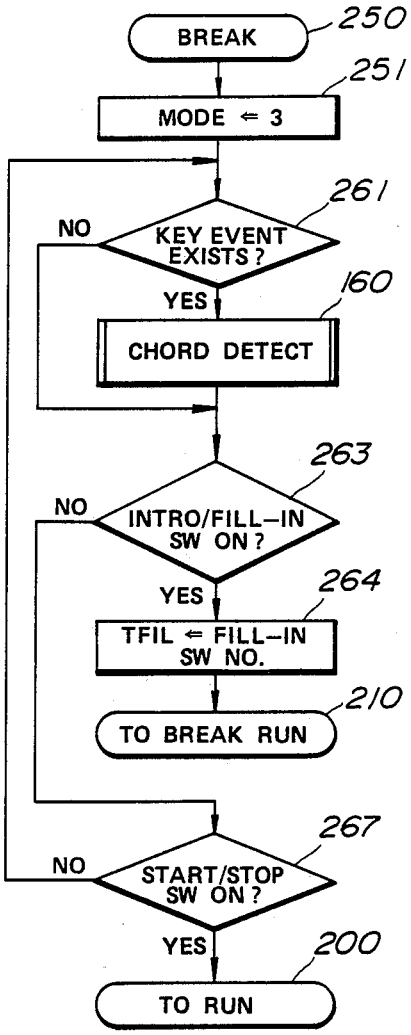
FIG. 9 is a flowchart showing a break mode process.

Referring to FIG. 9, data "3" representative of the break mode are stored in the mode register MODE in a step 251, and then it is judged whether any key event exists or not in a next step 261.

When the step 261 judges that the key event exists, the processing proceeds to the step 160 (as shown in FIG. 6) wherein the chord is detected by the key-depression state and then the root tone and chord type of the detected chord are respectively stored in the registers TROOT and TTYPE. Thereafter, the processing proceeds to a step 263. On the other hand, when the step 261 judges that the key event does not exist, the processing directly proceeds to the step 263 from the step 261.

In the step 263, the I/F switches 54 to 58 are examined. When any one of the I/F switches 54 to 58 is turned on, the number ("1" to "3") of "ON" I/F switch is stored in the register TFIL in a step 264, and then the processing proceeds to the step 210 of break run mode (shown in FIG. 8A). When any one of the I/F switches 54 to 58 is not turned on at all, the processing proceeds to a step 267. The step 210 of break run mode represents the operation in that the initializations of registers concerning the tempo clock CLK (in the step 202) are skipped from the step 200 of run mode process. Hence, the states of these registers are set identical to those just before the break. For this reason, due to the break run mode, it is possible to re-start the automatic performance of rhythm (and accompaniment) at the section timing identical to that in the case where the break is not executed.

In the step 267, the S/S switch 50 is examined. When the S/S switch 50 is turned on, the processing proceeds to the step 200 of run mode process (shown in FIGS. 8A and 8B). On the contrary, when the S/S switch 50 is not turned on, the processing returns to the step 261 from the step 267. In the case where the mode is transited from the break mode to the run mode due to "ON" of the S/S switch 50, the automatic performance of rhythm etc. is re-started by a new timing determined by the on-timing of the S/S switch 50 in order to initialize the registers concerning the tempo clock CLK in the step 202.

(5) Ending Mode Process

In the present electronic musical instrument, when the S/E switch 52 is turned on in the run mode, the mode is changed over to the ending mode at a timing corresponding to the on-timing of S/E switch 52. For example, when the S/E switch 52 is turned on in the former part of bar, the mode is immediately changed over to the ending mode. On the other hand, when the S/E switch 52 is turned on in the latter part of bar, the mode is changed over to the ending mode at the head portion of next bar. On the operation, after the value "1" is set to the register TEND in the step 216 of the run mode (shown in FIG. 8B), an ending check process (shown in FIG. 18) will be executed in a clock interrupt process (shown in FIGS. 11A and 11B) which will be described later. At this time, the mode processing is transited to this ending mode process when the clock number CLK is smaller than "15" in a step 671 and the clock interrupt is canceled. In this ending mode, the chord data at an ending start timing are held but the chord is inhibited from being changed after the ending start timing.

Figure 10:
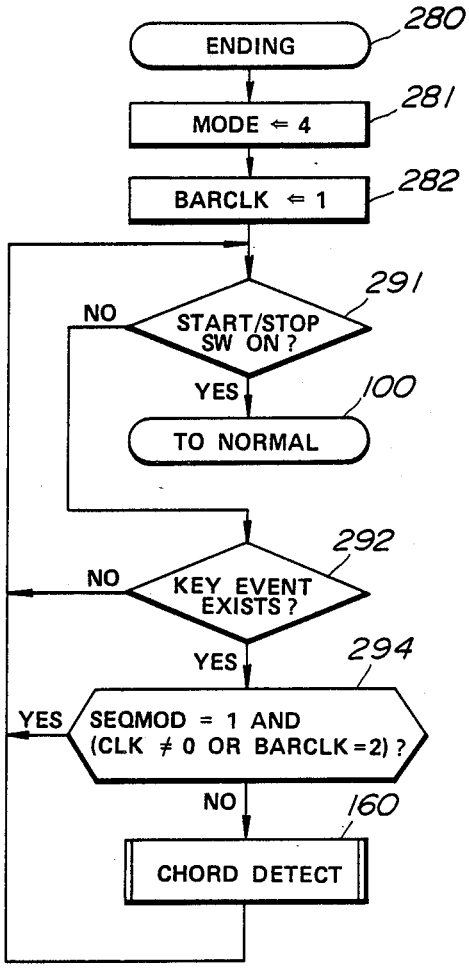
FIG. 10 is a flowchart showing an ending mode process.

Referring to FIG. 10, data "4" representative of the ending mode are stored in the mode register MODE in a step 281. The bar number BARCLK is set to the value "1" in a step 282, and thereafter, the S/S switch 50 is examined in a step 291. When the S/S switch 50 is turned on, the processing proceeds to the step 100 of normal mode (shown in FIG. 5A). On the other hand, when the S/S switch 50 is not turned on, the processing proceeds to a step 292 wherein it is judged whether any key event exists or not.

If the step 292 judges that the key event does not exist, the processing returns back to the step 291. If the step 292 judges that the key event exists, the CPU 10 examines the sequencer mode register SEQMOD, and the section timings BARCLK and CLK in a step 294. If the sequencer mode represents the reproduction mode (i.e., SEQMOD=1), the timing coincides with the second bar (i.e., BARCLK=2) or the timing coincides with the timings other than the head timing of bar (i.e., CLK does not equal to "0"), the processing directly returns to the step 291. In other words, the chord detection based on the key event data is not executed at the timings other than the head timing of first bar in the sequencer play cycle of the ending mode process. On the other hand, if the present mode is not the sequencer play mode, or if it is the head timing of first bar in the sequencer play mode, the processing proceeds to the step 160 (shown in FIG. 6) wherein the chord is detected based on the present key-depression state and then the root tone and chord type of the detected chord are respectively stored in the registers TROOT and TTYPE. Thereafter, the processing returns to the step 291. This is why it is not preferable that the chord is frequently changed just before the ending of tune. Hence, if the sequencer play mode is "ON" in the ending mode cycle, the present electronic musical instrument ignores the keyboard operation after the first section of first bar.

(6) Clock Interrupt Process I

Figure 11A:
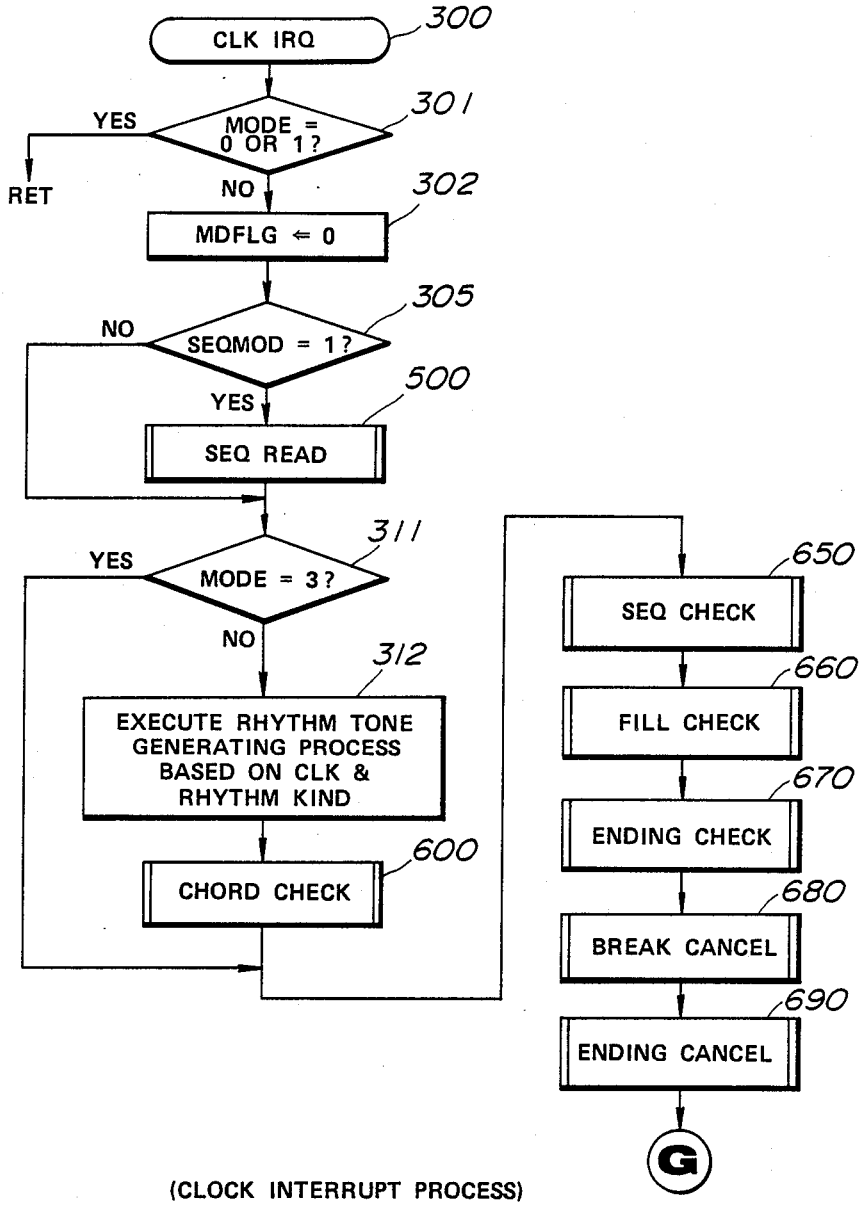
FIGS. 11A and 11B are flowcharts showing a clock interrupt process.

The tempo generator 24 outputs the tempo clock at every 1/32 cycle of one bar, and the present electronic musical instrument uses this tempo clock as an interrupt signal and then executes a step 300 of clock interrupt process (shown in FIG. 11A).

Referring to FIG. 11A, the content of mode register MODE is checked in a step 301. If the present mode is the normal mode (i.e., MODE=0) or the synchro standby mode (i.e., MODE=1), a tone generation process of rhythm and accompaniment tone and a counting process of tempo clock are not necessary, so that the interrupt is immediately canceled and then the processing returns back to the original process.

On the other hand, if the present mode is the mode other than the normal mode and the synchro standby mode, the processing proceeds to a step 302 wherein the mode change flag MDFLG is reset, and thereafter, the CPU 10 checks the content of sequencer mode register SEQMOD in a step 305. When the content of sequencer mode register SEQMOD is "1", the present sequencer mode is the sequencer play mode. In this case, the CPU 10 executes a step 500 of sequencer reading process (shown in FIG. 12A). If the present sequencer mode is the mode other than the sequencer play mode, the processing directly proceeds to a step 311 from the step 305.

(7) Sequencer Reading Process

In the present electronic musical instrument, the sequencer has a resolution of eighth note, i.e., a resolution of four clocks. More specifically, eighth note is set as one beat in the event data of sequencer, and such event data are read from and written into the sequencer at a timing of head clock (i.e., beat top) of eighth note.

Figures 11B, 12A:
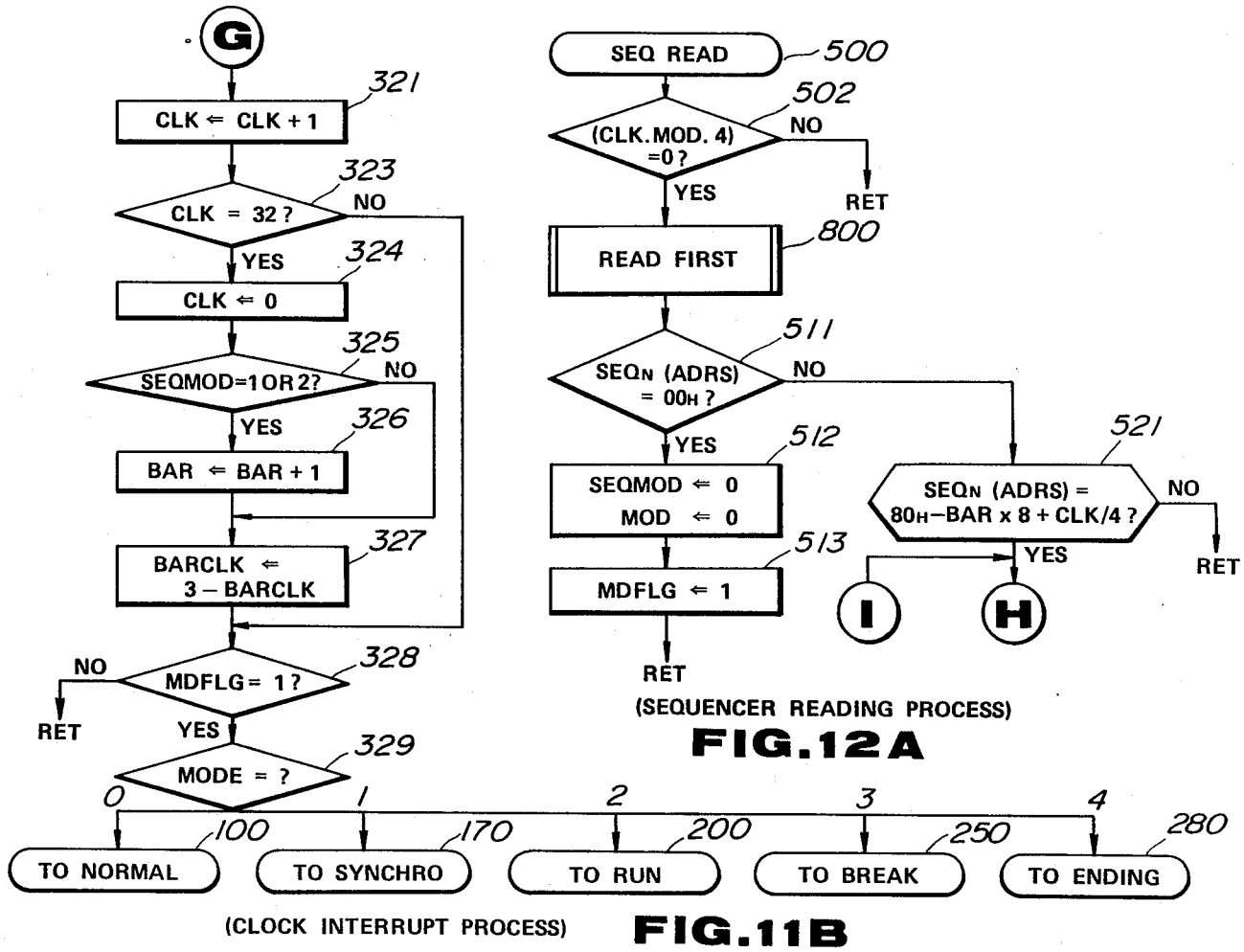
FIGS. 12A and 12B are flowcharts showing a sequencer reading process.
Figure 12B:
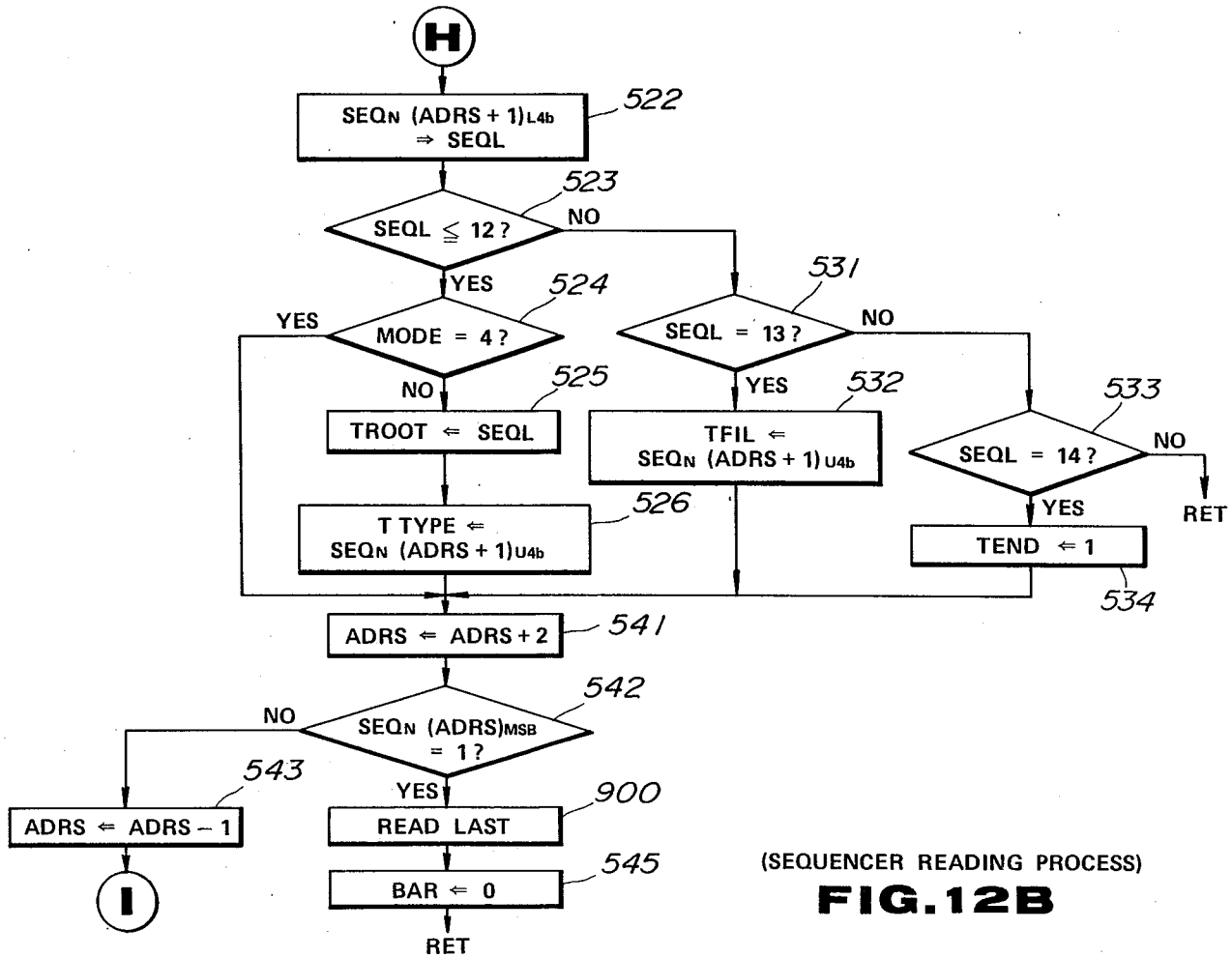

Referring to FIG. 12A, it is judged whether the tempo clock CLK can be divided by four or not in a step 501. In other words, the step 501 judges whether it is the reading timing (or beat top) of eighth note or not. When it is not the reading timing, the processing directly returns back to the original process (i.e., the step 311 shown in FIG. 11A). On the contrary, when it is the reading timing, the processing proceeds to a step 800 of read first process (shown in FIG. 13). After executing the read first process, the processing proceeds to a step 511 wherein the CPU 10 checks data $SEQ_N$(ADRS) stored at an address designated by the address pointer ADRS of the sequencer $SEQ_N$ to be read out. In this step 511, data $00_H$ indicate that the sequencer data to be read out are completely read out. Therefore, when $SEQ_N(ADRS)=00_H$, the sequencer mode register SEQMOD and the operation mode register MODE are both cleared in a step 512. In short, the sequencer is "OFF" and the operation mode is set to the normal mode. Next, the value "1" is set to the mode change register MDFLG in a step 513, and then the processing returns to the original process (i.e., the step 311 shown in FIG. 11A.

If the data $SEQ_N$(ADRS) read out in the step 511 are other than the data $00_H$, the processing proceeds to a step 521 wherein it is judged whether such data $SEQ_N$(ADRS) are identical to timing data ($80_H$+BAR+CLK/4) which represent the same timing of a present timing (BAR+CLK/4) or not. When the data $SEQ_N$(ADRS) are not identical to the above timing data, the processing returns to the original process (i.e., the step 311 of FIG. 11A). On the contrary, when the data $SEQ_N$(ADRS) are identical to the above timing data, the processing proceeds to a step 522 (shown in FIG. 12B) wherein lower four bits of data $SEQ_N$(ADRS+1) of next address are read out and then stored in the lower bit register SEQL. Thereafter, the kind of this data SEQL are judged in steps 523, 531 and 533.

If the (root tone) data SEQL are the chord data (i.e., the value of data SEQL is equal to or smaller than "12"), the processing proceeds to a step 524 from the step 523. In the step 524, it is judged whether the present operation mode is the ending mode (i.e., MODE=4) or not. When the present mode is judged to be the ending mode, the processing directly proceeds to a step 541. On the contrary, when the present mode is not the ending mode, the processing proceeds to a step 525 wherein the root tone data SEQL are stored in the register TROOT. In a next step 526, upper four bits of the data $SEQ_N$(ADRS+1) (i.e., chord type data) are stored in the register TTYPE, and then the processing proceeds to a step 541.

If the data SEQL are the intro/fill-in data (i.e., SEQL="13"), the processing proceeds to a step 532 from the step 531. In the step 532, the upper four bits of the data $SEQ_N$(ADRS+1) (i.e., the number ("1" to "3") of intro/fill-in pattern) are stored in the register TFIL, and then the processing proceeds to the step 541.

If the data SEQL indicate the ending command (i.e., SEQL="14"), the processing proceeds to a step 534 from the step 533. In the step 534, data "1" representative of the ending mode are stored in the register TEND, and then the processing proceeds to the step 541.

If the data SEQL are not identical to the chord data, the intro/fill-in data and the ending command at all (i.e., if the value of data SEQL is not equal to any one of "1" to "14"), the processing returns to the original process (i.e., the step 311 of FIG. 11A) from the step 533.

In the step 541, the value of address pointer ADRS is counted up to the next reading position by two. In a next step 542, the most significant bit (MSB) of data stored in the address pointer ADRS is examined. If this MSB equals to "1", such data are the timing data representative of the next reading timing. However, if the MSB equals to "0", it can be said that some data to be read out by the present timing must be still remained. For this reason, if the MSB equals to "0", the value of address pointer ADRS is decremented by one in a step 543. Thereafter, the processing returns to the step 522, whereby the CPU 10 repeatedly executes reading process of the data next to the read event data.

Figure 14:
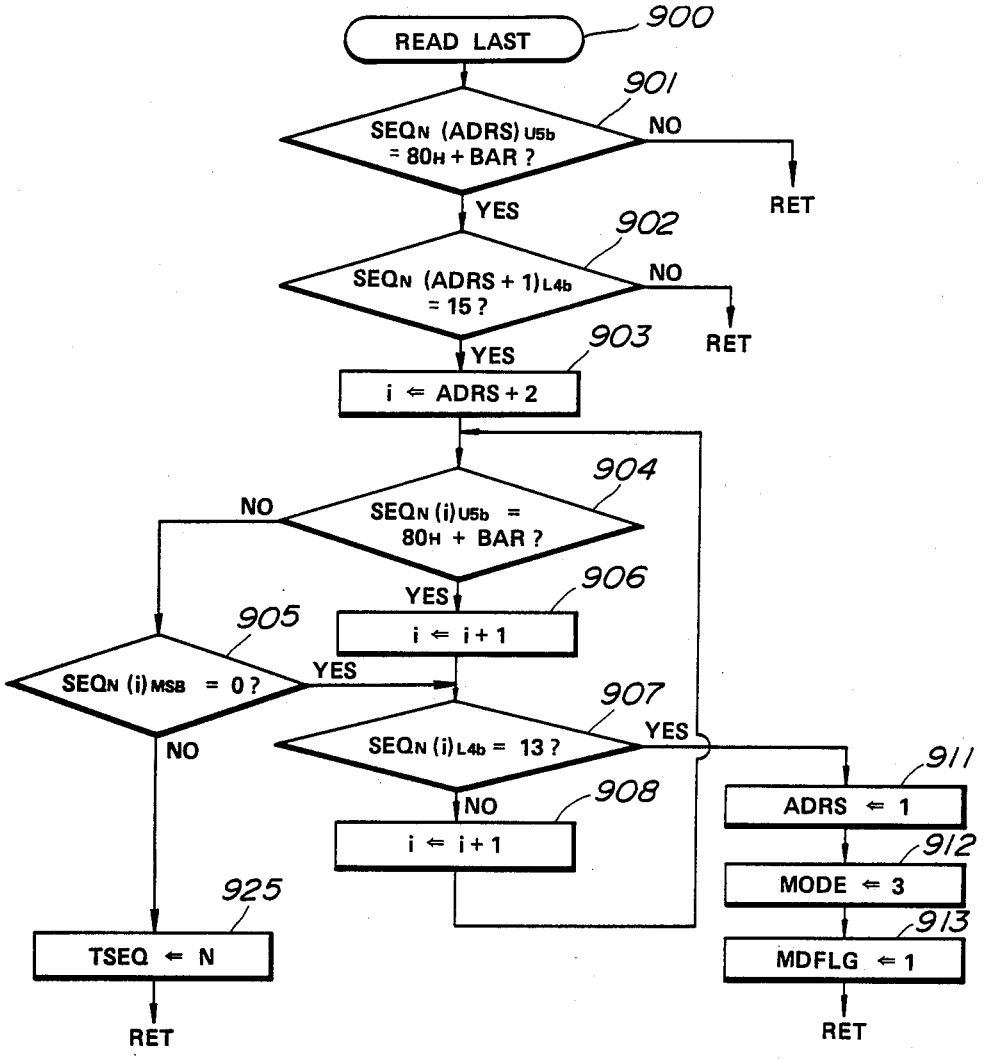
FIG. 14 is a flowchart showing a read last process.

Meanwhile, if the data examined in the step 542 are the timing data (i.e., MSB="1"), the CPU 10 executes a step 900 of read last process (shown in FIG. 14). Then, after the bar number register BAR is cleared in a step 545, the processing returns to the original process (i.e., the step 311 of FIG. 11A).

(8) Read First Process

In the present electronic musical instrument, the stop command is written in the sequencer $SEQ_N$ designated by the SEQ switches 62 to 66. In the case where the intro/fill-in data are written at a certain latter timing within the bar including the event timing of this stop command, the mode is transited to the break mode at the timing of the stop command and then transmitted to the run mode at the timing of intro/fill-in data.

Figure 13:
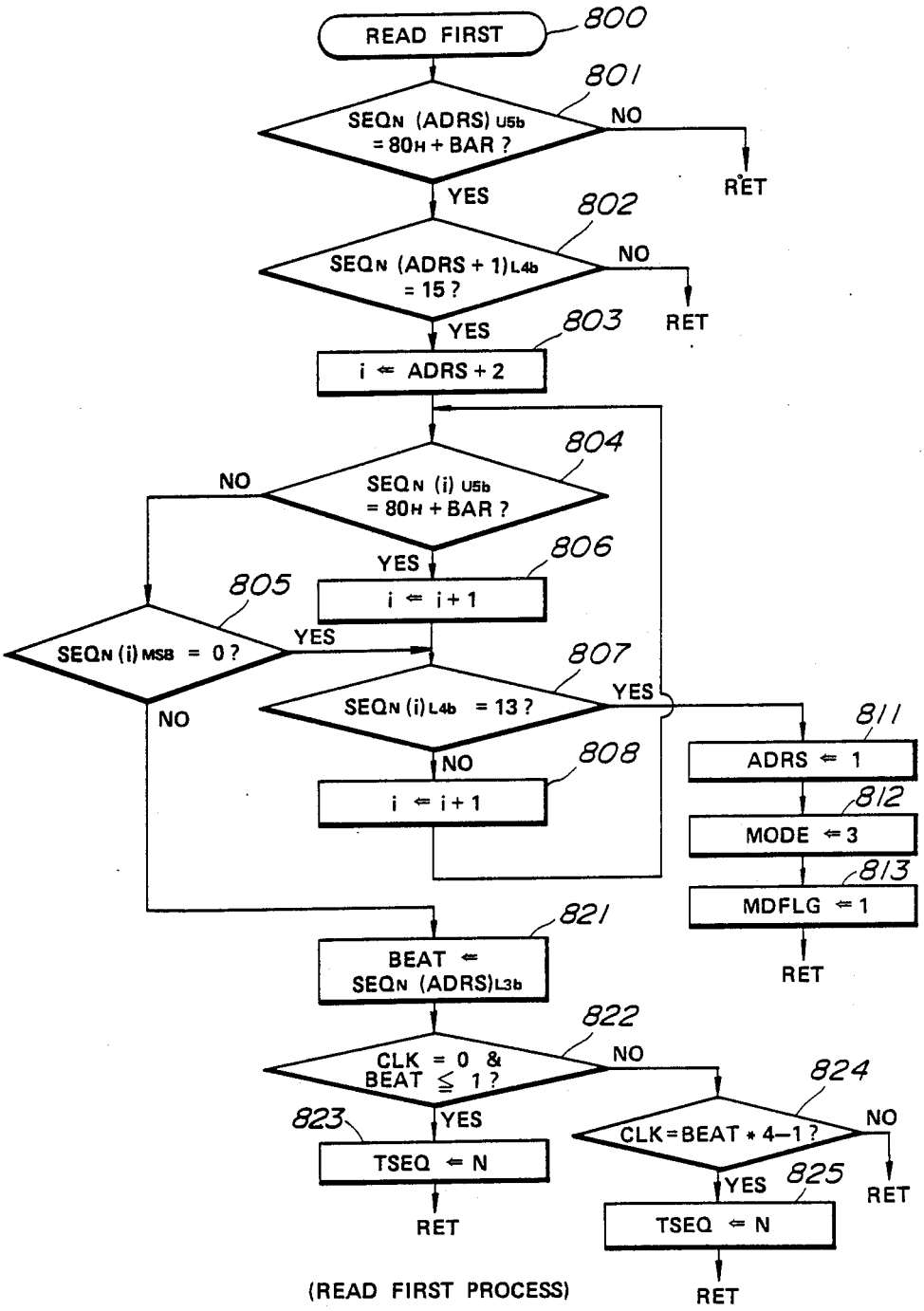
FIG. 13 is a flowchart showing a read first process.

Referring to FIG. 13, the CPU 10 examines upper five bits of data $SEQ_N$(ADRS) stored in the address pointer ADRS of sequencer $SEQ_N$ in a step 801. If the MSB of such data $SEQ_N$(ADRS) equals to "1", such data are the timing data, so that second to fifth bits of such data represents the number of bars; from the bar in which the preceding event is caused to the present bar. In the case where such data $SEQ_N$(ADRS) are not the timing data, and in the case where such data are the timing data but the bar number BAR is different from the bar number represented by the second to fifth bits of timing data, the processing returns to the original process (i.e., the step 511 of FIG. 12A).

On the other hand, in the case where the data $SEQ_N$(ADRS) are the timing data and the bar number BAR equals to the bar number of timing data, the CPU 10 examines lower four bits of data $SEQ_N$(ADRS+1) of the next address in a step 802. The data including lower four bits having decimal value "15" represent the stop command. If the data $SEQ_N$(ADRS+1) do not represent the stop command, the processing returns to the original process (i.e., the step 511 of FIG. 12A).

If the data $SEQ_N$(ADRS+1) represent the stop command, the processing proceeds to a step 803 wherein a value obtained by adding "2" to the data value of address pointer ADRS is stored in the pointer i. In a next step 804, the CPU 10 examines upper five bits of data $SEQ_N$(i) so as to judge whether such data $SEQ_N$(i) are the timing data ($80_H$+BAR) having the bar number data representative of the same bar number of the present bar number BAR or not.

When the above upper five bits represent the timing data ($80_H$+BAR), the value of pointer i is increased by one in a step 806. Further, it is judged whether lower four bits of next data $SEQ_N$(i) represent decimal value "13" or not in a step 807. In other words, it is judged whether the next data $SEQ_N$(i) are the intro/fill-in data or not in the step 807. When the next data $SEQ_N$(i) are not the intro/fill-in data, the value of pointer i is further increased by one, and then the processing returns to the step 804. On the contrary, when the next data $SEQ_N$(i) are the intro/fill-in data, the value of pointer i is set to the address pointer ADRS in a step 811, the operation mode is changed to the break mode in a step 812, the mode change flag MDFLG is set in a step 813, and thereafter, the processing returns to the original process (i.e., the step 511 of FIG. 12A).

If the judgment result of step 804 is "NO", the processing proceeds to a step 805 wherein it is judged whether the data $SEQ_N$(i) are the timing data or not. When the data $SEQ_N$(i) are the timing data, the processing branches to the step 807 wherein the CPU 10 searches the intro/fill-in data within the succeeding data of the data $SEQ_N$(i). On the contrary, when the data $SEQ_N$(i) are not the timing data, the lower three bits of data $SEQ_N$(ADRS) representative of the beat data are set to the register BEAT in a step 821. Next, it is judged whether the present clock CLK equals to value "0" or not and whether the beat BEAT is smaller than or equal to "1" or not in a step 822. When the clock CLK equals to value "0" and the beat BEAT is smaller than or equal to "1", the sequencer number N ("1" to "3") is stored in the register TSEQ in a step 823, and thereafter, the processing returns to the original process (i.e., the step 511 of FIG. 12A). On the contrary, when the clock CLK is not equal to value "0" or when the beat BEAT is larger than "1", the processing proceeds to a step 824 wherein it is judged whether the clock CLK is equal to a value of BEAT*4+1 or not. If the judgment result of this step 824 is "NO", the processing directly returns to the original process (i.e., the step 511). If the judgment result of this step 824 is "YES", the sequencer number N is stored in the register TSEQ in a step 825, and then the processing returns to the original process (i.e., the step 511 of FIG. 12A).

(9) Read Last Process

The read last process shown in FIG. 14 is identical to the process obtained by canceling the steps 821 to 824 from the read first process shown in FIG. 13. In FIG. 14, each of the steps corresponding to those of FIG. 13 will be designated by the number having the lower two figures identical to the number of corresponding step and a hundred order of "9". Hence, detailed description of this read last process will be omitted.

(10) Clock Interrupt Process II

Successively to the step 305 shown in FIG. 11A or the step 500 of sequencer reading process (shown in FIGS. 12A and 12B), it is judged whether the operation mode is the break mode (i.e., MODE=3) or not in the step 311. When the operation mode is not the break mode, the processing proceeds to a step 312 wherein the CPU 10 executes a rhythm tone generating process based on the clock count value CLK and the rhythm kind (i.e., the values of registers TROOT and TTYPE). Then, after executing a step 600 of chord check process (shown in FIG. 15), the CPU 10 sequentially executes a step 650 of sequencer check process (shown in FIG. 16), a step 660 of fill-in check process (shown in FIG. 17), a step 670 of ending check process (shown in FIG. 18), a step 680 of break cancel process (shown in FIG. 19) and a step 690 of ending cancel process (shown in FIG. 20). Thereafter, the processing proceeds to a step 321 shown in FIG. 11B.

Meanwhile, when the step 311 (shown in FIG. 11A) judges that the operation mode is the break mode, the rhythm tone generating process is not required. Hence, in this case, the step 312 and the step 600 of chord check process are both skipped and then the CPU 10 executes each process of the above-mentioned step 650 of sequencer check process to the step 690 of ending cancel process. Thereafter, the processing proceeds to the step 321 (shown in FIG. 11B).

In the step 321, the clock counter CLK is counted up. In successive steps 323 to 327, the CPU 10 executes a carry process in the case where the counter CLK for counting decimal values "0" to "31" counts decimal value "32".

More specifically, the step 323 judges whether the count value of counter CLK reaches at decimal value "32" or not. If the count value of counter CLK is not equal to "32", the processing directly proceeds to a step 328.

On the contrary, when the count value of counter CLK is equal to "32", the counter CLK is reset in the step 324, and then the step 325 judges whether the sequencer is "ON" or not. When the sequence is judged to be "ON", the bar number BAR is increased by one in the step 326 and then the processing proceeds to the step 327. On the other hand, when the sequencer is judged to be "OFF", the step 326 is skipped and then the processing directly proceeds to the step 327. In the step 327, the bar number BARCLK is changed to "2" when the bar number BARCLK equals to "1", while the bar number BARCLK is changed to "1" when the bar number BARCLK equals to "2".

In the step 328, the CPU 10 examines the mode change flag MDFLG so as to judge whether any mode change is executed or not. When there is no mode change, the CPU 10 cancels the interrupt and then the processing returns to the original process. When there is any mode change executed, the processing passes through a step 329 and then returns to the process corresponding to the changed operation mode within the step 100 of normal mode, the step 170 of synchro standby mode, the step 200 of run mode, the step 250 of break mode and the step 280 of ending mode.

(11) Ending Check Process

Figure 15:
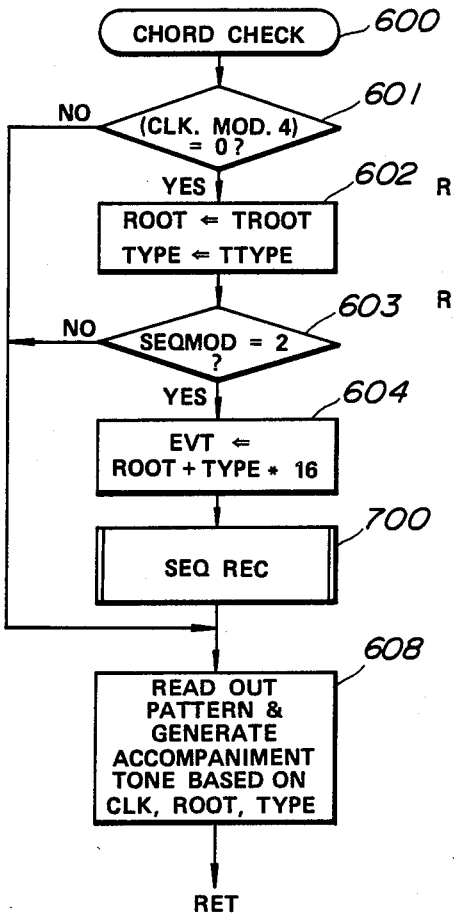
FIG. 15 is a flowchart showing a chord check process.

Referring to FIG. 15, it is judged whether the count value of clock counter CLK can be perfectly divided by four or not in a step 601. When such count value can be perfectly divided by four, the present timing coincides with the head timing (or the bet top) of eighth note, i.e., the present timing coincides with the event timing. In this case, the chord data of the registers TROOT and TTYPE are transferred to the registers ROOT and TYPE respectively in a step 602, and then it is judged whether the sequencer recording is set or not in a step 603. When the sequencer recording is judged to be set, the lower four bits of register EVT are stored with the root tone data ROOT and the upper four bits thereof are stored with the chord type data TYPE in a step 604. Then, after a step 700 of sequencer writing process (shown in FIGS. 21A and 21B) is executed, the processing proceeds to a step 608.

When the step 601 judges that the present timing does not coincide with the beat top of eighth note, or when the step 603 judges that the sequencer recording is not set, the processing directly proceeds to the step 608 from the step 601 or 603.

In the step 608, a pattern is read out based on the clock count value CLK, the chord data ROOT and TYPE so that the accompaniment tone will be generated, and then the processing returns to the original process.

(12) Sequencer Check Process

Figure 22:
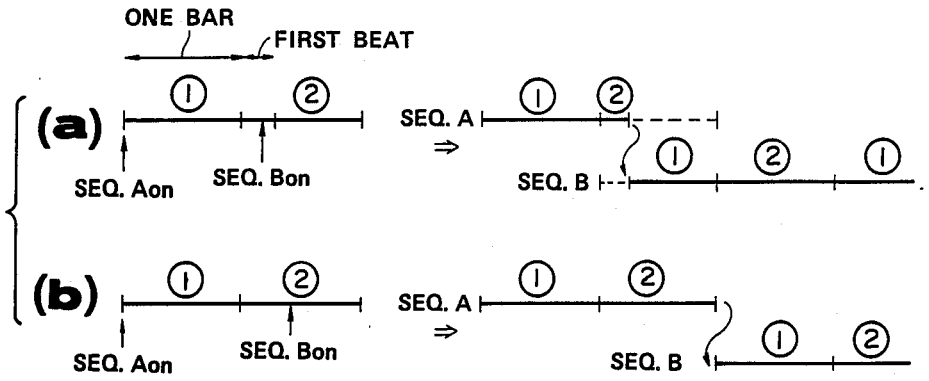
FIGS. 22(*a*)and 22(*b*) show diagrams for explaining sequencer changeover states.

When any one of the SEQ switches 62 to 66 is turned on in the automatic accompaniment performance, the present electronic musical instrument starts to play the accompaniment based on the new sequencer at a predetermined timing corresponding to the on-timing of the SEQ switch. For example, when the SEQ switch is turned on within the first section, the present sequencer is changed over to the new sequencer at the head timing of the second section. In addition, when the SEQ switch is turned on at a timing after the second section and the succeeding sections of a certain bar, the present sequencer is changed over to the new sequencer at the head timing of next bar. FIGS. 22(*a*) and 22(*b*) show on-timings of SEQ switches A and B and accompaniment change-over states.

Figure 16:
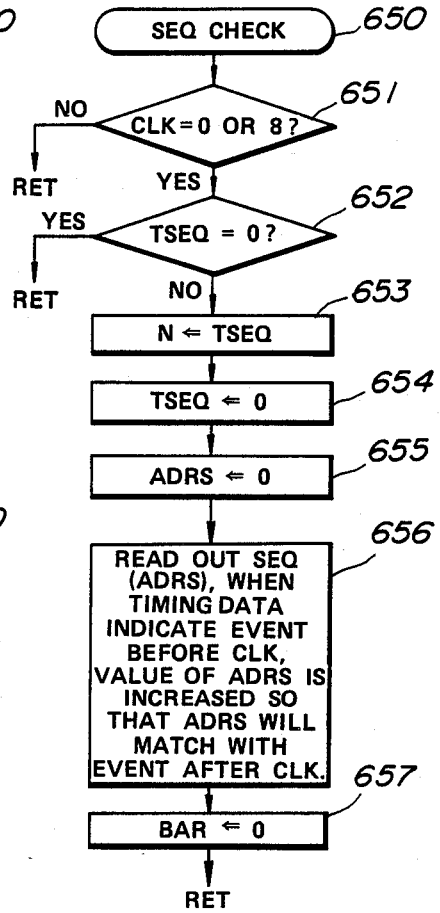
FIG. 16 is a flowchart showing a sequencer check process.

Referring to FIG. 16, when the clock value CLK indicates the decimal value other than "0" (indicative of the head timing of bar) or "8" (indicative of the head timing of second section) in a step 651, the processing immediately returns to the original process. On the contrary, when the clock value CLK indicates the decimal value "0" or "8", the processing proceeds to a step 652 wherein it is judged whether the content of register TSEQ is "0" or not. When TSEQ="0", any one of the SEQ switches 62 to 66 is not newly operated, so that the processing directly returns the original process.

On the other hand, when the content of register TSEQ equals to N not equal to "0"), the first event (or reading) timing will be come after any one of the SEQ switches 62 to 66 is operated. In this case, the content of register TSEQ is transferred to the register N in a step 653, the register TSEQ is cleared in a step 654 and then the address pointer ADRS is reset in a step 655. In a next step 656, the data $SEQ_N$(ADRS) are read from the sequencer. In this case, when the timing data of the above data $SEQ_N$(ADRS) indicate the event timing before the timing of CLK, the address pointer ADRS is adjusted to the position of event data after the timing of CLK by increasing the value of pointer ADRS. Thereafter, the bar number register BAR is cleared in a step 657, and then the processing returns to the original process.

(13) Fill-In Check Process

Figure 23:
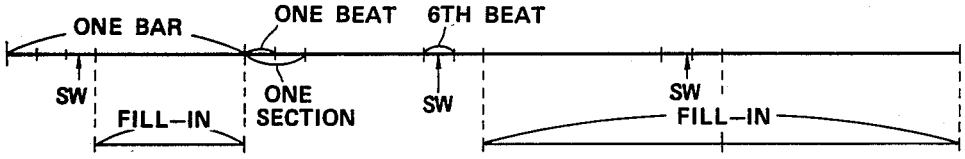
FIG. 23 shows a diagram for explaining a fill-in changeover state.

If any one of the fill-in switches 54 to 58 is operated in the run mode, the pattern of the present electronic musical instrument is changed over to the fill-in pattern at the predetermined timing corresponding to the operating timing of fill-in switch. For example, when any one of the fill-in switches 54 to 58 is turned on before the fourth section (or sixth and seventh beats), the present pattern is changed over to the fill-in pattern corresponding to the "ON" fill-in switch at the beat top immediately after the fill-in switch is turned on. On the other hand, when the fill-in switch is turned on within the fourth section (i.e., CLK is larger than or equal to "24"), the present pattern is changed over to the fill-in pattern at the head timing of next bar. In addition, when the fill-in pattern is performed and then the present timing comes to the head timing of next bar, such performance of fill-in pattern is completed. FIG. 23 shows the performance pattern change-over state due to the on-timings of I/F switches 54 to 58.

Figure 17:
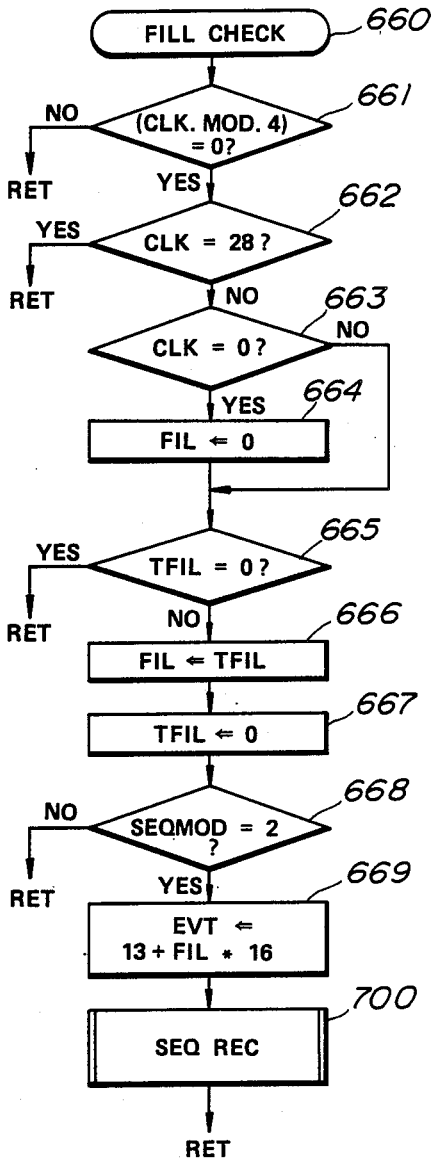
FIG. 17 is a flowchart showing a fill-in check process.

Referring to FIG. 17, it is judged whether the present timing CLK coincides with the beat top or not in a step 661. If the present timing is not the beat top, the processing directly returns to the original process. When the present timing is the beat top, the processing proceeds to a next step 662 wherein it is judged whether the present timing is the seventh beat or not. If the present timing is the seventh beat, the processing directly returns to the original process. On the contrary, when the present timing is not the seventh beat, the processing proceeds to a step 663 wherein it is judged whether the present timing coincides with the head timing of bar (i.e., CLK="0") or not. When the present timing is the head timing of bar, the processing proceeds to a step 664 wherein the register FIL is cleared. Thus, the performance of fill-in pattern which is performed until this time will be canceled. If the present timing is judged not to be the head timing of bar, the process of step 664 will be skipped.

In a next step 665, the content of register TFIL is examined. If TFIL="0", the processing directly returns to the original process. If TFIL equals not "0", any one of the I/F switches 54 to 58 is operated so that it will be the first timing for changing over the fill-in patterns. Thereafter, the content of register TFIL is transferred to the register FIL in a step 666, and then the register TFIL is cleared in a step 667. Next, it is judged whether the present sequencer mode is the recording mode (i.e., SEQMOD="2") or not in a step 668. If the sequencer mode is not the recording mode, the processing returns to the original process. When the sequencer mode is the recording mode, the processing proceeds to a step 669 wherein fill-in data "13" are stored in the lower four bits of event register EVT and the fill-in pattern number FIL is stored in the upper four bits of event register EVT. Then, after a step 700 of sequencer recording process (shown in FIGS. 21A and 21B) is executed, the processing returns to the original process.

(14) Ending Check Process

Figure 18:
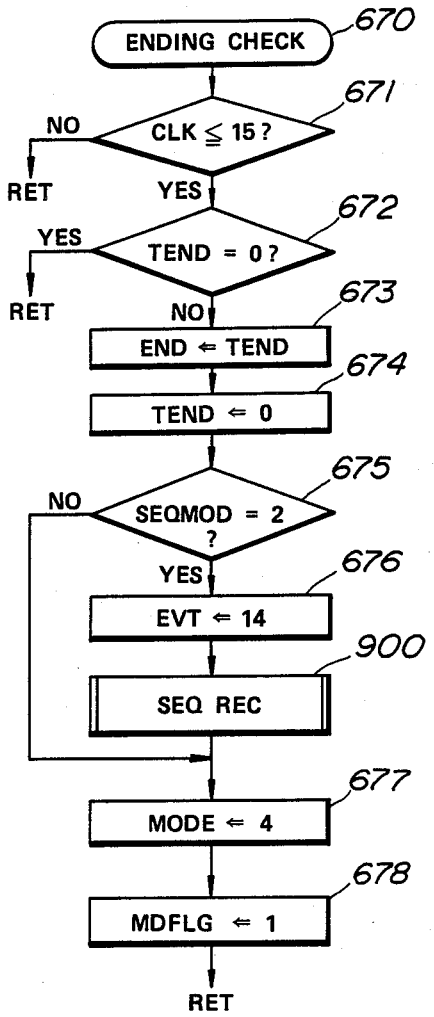
FIG. 18 is a flowchart showing an ending check process.

Referring to FIGS. 18, it is judged whether the value of clock CLK is smaller than or equal to decimal value "15" or not in a step 671, and then the register TEND is examined in a next step 672. In this case, the value of clock CLK becomes larger than the decimal value "15" when the S/E switch 52 is turned on in the latter part of bar, and the content of register TEND becomes equal to "3" when the S/E switch 52 is not turned on. For this reason, in the present case, the processing will return to the original process from the step 671 or 672. In the case where the value of clock CLK is smaller than the decimal value "15" and value "1" is stored in the register TEND, the content of register TEND is transferred to the register END in a step 673. Then, after the register TEND is cleared in a step 674, the processing proceeds to a step 675 wherein it is judged whether the present sequencer mode is the recording mode (i.e., SEQMOD="2") or not. If the present sequencer mode is judged to be the recording mode, the ending data are stored in the event data register EVT in a step 676. Then, after the step 900 of sequencer writing process (shown in FIGS. 21A and 21B) is executed, the processing proceeds to a step 677. On the contrary, when the present sequencer mode is judged not to be the recording mode, the processing directly proceeds to the step 677 from the step 675.

In the step 677, the operation mode is set to the ending mode (i.e., MODE="4"). Then, after the mode change flag MDFLG is set in a step 678, the processing returns to the original process.

(15) Break Cancel Process

Figure 24:
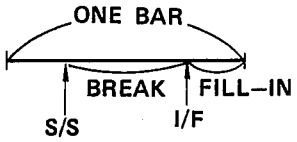
FIG. 24 shows a diagram for explaining a break transfer state-.

The mode of the present electronic musical instrument is changed to the break mode so that the performance of rhythm and chord will be broken at the beat top just after the S/S switch 50 is turned on in the clock execution (i.e., the run mode). In addition, when any one of the I/F switches 54 to 58 is turned on within the same bar wherein the S/S switch 50 is turned on, the clock is maintained as it is and the performance will be re-started in accordance with the fill-in pattern of the "ON" I/F switch. FIG. 24 shows the change of performance state due to the on-timings of the S/S switch 50 and I/F switches 54 to 58. Incidentally, when any one of the I/F switches 54 to 58 is not turned on until the end of bar wherein the mode is changed over to the break mode, this break mode is changed over to the normal mode and then the automatic performance will be stopped.

Figure 19:
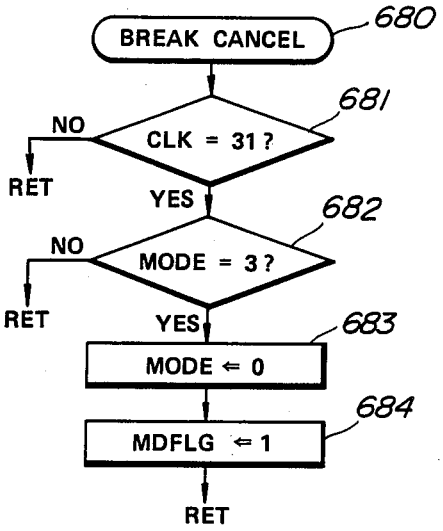
FIG. 19 is a flowchart showing a break cancel process.

Referring to FIG. 19, it is judged whether the present timing coincides with the end timing of bar (i.e., CLK="31") or not in a step 681. In a next step 682, it is judged whether the present operation mode is the break mode (i.e., MODE="3") or not. In the case where the present timing is not the end timing of bar or the present operation mode is not the break mode, the processing immediately returns to the original process.

When the the present timing is the end timing of bar and the present operation mode is the break mode, the processing proceeds to a step 683 wherein the normal mode is set to the operation mode register MODE (i.e., MODE="0"). Further, the mode change flag MDFLG is set in a step 684, and then the processing returns to the original process.

(16) Ending Cancel Process

The present electronic musical instrument is designed to stop the automatic performance when the performance of two bars are completely played in the ending mode.

Figure 20:
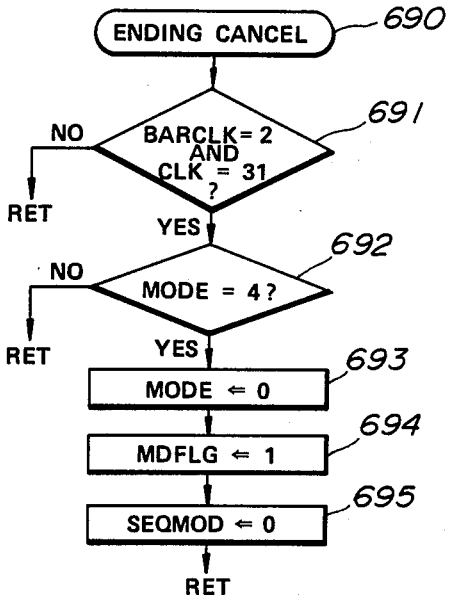
FIG. 20 is a flowchart showing an ending cancel process.

Referring to FIG. 20, it is judged whether the present timing coincides with the end timing of second bar (i.e., BARCLK="2") or not in a step 691, and then it is judged whether the present operation mode is the ending mode (i.e., MODE="4") or not in a step 692. In the case where the present timing is not the end timing of second bar or the present operation mode is not the ending mode, the processing immediately returns to the original process.

On the contrary, in the case where the present timing is the end timing of second bar and the present operation mode is the ending mode, the processing proceeds to a step 693 wherein the normal mode is set to the operation mode register MODE (i.e., MODE="0"). Then, the mode change flag MDFLG is set in a step 694, and the sequencer mode is set to "OFF" (i.e., SEQMOD="0") in a step 695. Thereafter, the processing returns to the original process.

(17) Sequencer Writing Process

In the present electronic musical instrument, the key operations of keyboard are detected by the resolution of eighth note. In this case, if the key depression has occurred within one clock period before each beat top or within one clock period after each beat top, such key depression is considered to be occurred just at each beat top and the event data thereof are subjected to the writing process.

Figure 21A:
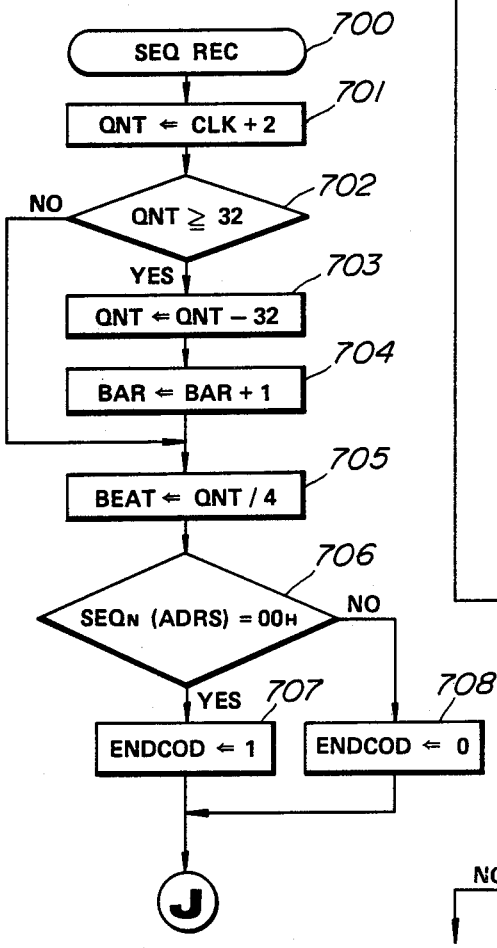
FIGS. 21A and 21B are flowcharts showing a sequencer recording (or writing) process; .
Figure 21B:
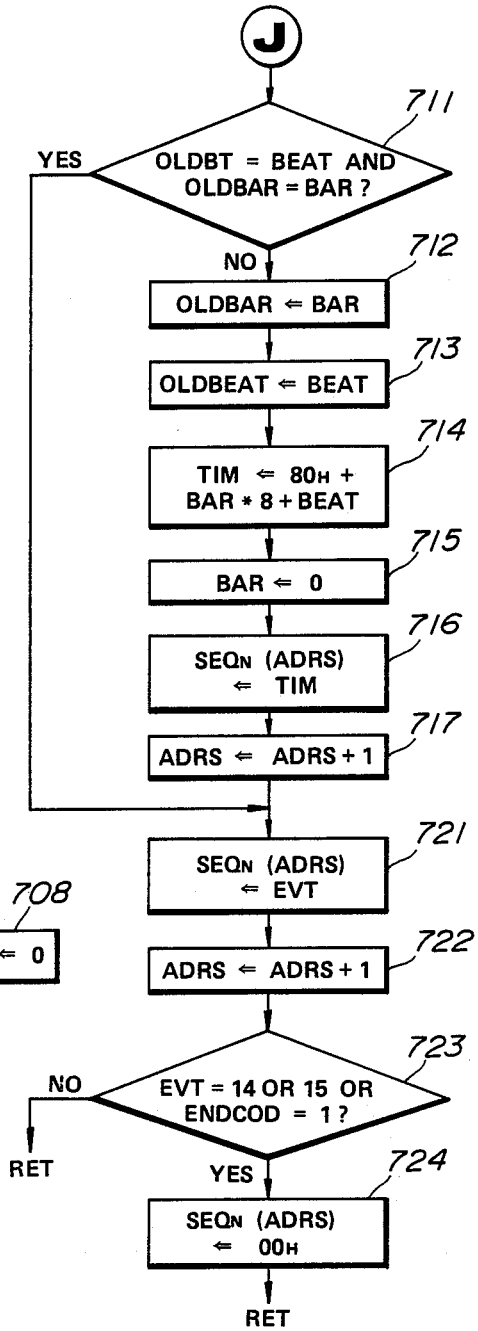

Referring to FIGS. 21A and 21B, the quantization register QNT stores value of (CLK+2) which is obtained by adding "2" to the clock count value CLK in a step 701, and then the value of such register QNT (hereinafter, referred to as quantization number QNT) is examined in a step 702. When this quantization number QNT is smaller than decimal value "32", the processing directly proceeds to a step 705 from the step 702. On the contrary, when the quantization number QNT is larger than or equal to the decimal value "32", the decimal value "32" is subtracted from the quantization number QNT in a step 703, the value of bar number register BAR is incremented by one in a step 704, and then the processing proceeds to the step 705. In the step 705, value which is obtained by dividing the quantization number QNT by four is stored in the register BEAT as the beat number.

In a next step 706, it is judged whether the data $SEQ_N$(ADRS) are identical to data $00_H$ or not. As described before, such data $00_H$ represent the sequencer ending command indicative of the end of event data. When the data $SEQ_N$(ADRS) are judged to be the data $00_H$, end data "1" are stored in the register ENDCOD in a step 707, and then the processing proceeds to a step 711 shown in FIG. 21B. On the contrary, when the data $SEQ_N$(ADRS) are other than the data $00_H$, the register ENCOD are cleared in a step 708, and then the processing proceeds to the step 711.

In the step 711, the present beat number BEAT is compared with the old beat number OLDBT, and the present bar number BAR is compared with the old bar number OLDBAR. When OLDBEAT=BEAT and OLDBAR=BAR at the same time, the processing directly proceeds to a step 721 from the step 711. When OLDBEAT is not equal to BEAT and/or OLDBAR is not equal to BAR, the processing proceeds to a step 712 wherein the content of old bar number register OLDBAR is renewed by or changed identical to the present bar number BAR. In a step 713, the content of old beat number register OLDBT is renewed by or changed identical to the present beat number BEAT. In a step 714, value "1" is stored at the MSB of timing data register TIM, the bar number BAR is stored at second to fifth bits thereof, and the beat number BEAT is stored at the lower three bits thereof. In a step 715, the register BAR is cleared. In a step 716, the timing data TIM are written at the address designated by the pointer ADRS of sequencer $SEQ_N$. In a step 717, the pointer ADRS is incremented by one. Thereafter, the processing proceeds to the step 721.

In the step 721, the event data EVT are written at the address next to the address at which the above-mentioned timing data TIM of sequencer $SEQ_N$ are written. Then, after the pointer ADRS is further incremented by one in a step 722, the contents of the event data EVT and the end code register ENDCOD are both examined in a step 723. When the event data EVT represents the ending command or the stop command, or when the end code is stored in the register ENDCOD, the data $00_H$ are stored at the address next to the addresses at which the above-mentioned data of sequencer $SEQ_N$ are written in a step 724, and then the processing returns to the original process. On the contrary, when the event data EVT represent the data other than the ending command or the stop command, and when the content of register ENDCOD is identical to "0", the processing directly returns to the original process from the step 723.

Figure 25:
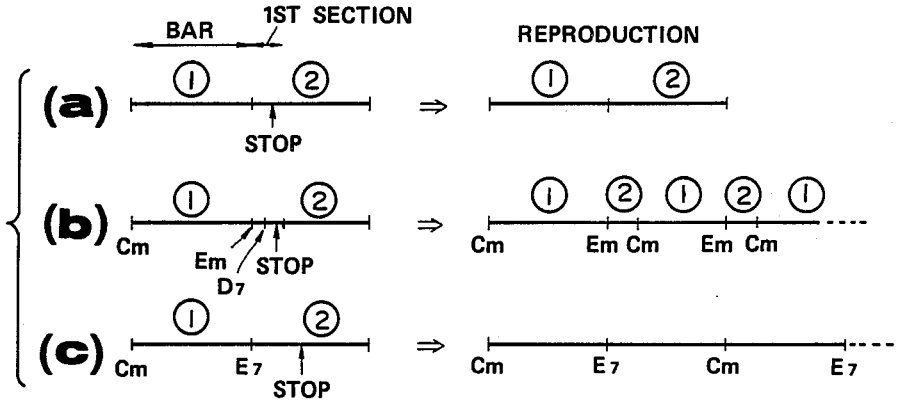
FIGS. 25(*a*), 25(*b*), and 25(*c*) show diagrams for explaining relations between sequencer write data and reproducing state.

FIGS. 25(*a*), 25(*b*), and 25(*c*) show relations between the write data for the sequencer and the reproduction states. In FIGS. 25(*a*), 25(*b*), and 25(*c*) ① and ② represent the first and second bars respectively, and characters "Cm", "Em", "D7" and "E7" represent the chord characters.

In the reproduction cycle, in the case where the sequencer data do not include the ending command, the performance based on the same sequencer data is repeatedly executed until the ending operation is executed by operating the S/S switch 50 or the S/E switch 52. On the other hand, in the case where the sequencer data include the ending command, the present electronic musical instrument will be stopped when this ending command is read out.

In the case where the stop switch 50 is turned on within the first section of the second bar in the write cycle, the performance until the preceding bar (i.e., the first bar) will be repeatedly played in the reproduction cycle as shown in FIG. 25(*a*). On the other hand, in the case, where any data (Em) are written within the first section of the second bar before the stop switch 50 is turned on such written data are executed (i.e., the first section of the second bar is performed), and the performance returns back to the second section of the first bar, and then such same performance (from the second section of first bar to the first section of second bar) will be repeatedly played in the reproduction cycle as shown in FIG. 25(*b*).

Incidentally, in the case where the performance is stopped after the second section of second bar in the write cycle, the data (E7) when the stop switch 50 is turned on are maintained until the last section of the second bar, and then such first and second bars (Cm and E7) will be repeatedly performed as shown in FIG. 25(*c*).

[MODIFIED EXAMPLES OF PRESENT EMBODIMENT]

This invention can be practiced or embodied in still other ways without being limited by the present embodiment described heretofore and without departing from the spirit or essential character thereof. For example, this invention can be modified as follows:

1. A rhythm select command can be used as the sequencer data;

2. In the present embodiment, addresses of plural sequencers are fixed. However, the present invention is not limited by that;

3. In spite that the rhythms and patterns of automatic performance are not shown in the description of the present embodiment, it is possible to vary such rhythms and patterns by the chord and the like;

4. In the present embodiment, the present mode can be returned to the run mode (i.e., mode "2") from the break mode (mode "3") within one bar only. However, the returning period when the break mode is changed to the run mode in the present invention is not limited to that of the present embodiment. For example, it is possible to set the period of two bars or more as such returning period;

5. The section timing at mode change-over cycle is not limited to that of the present embodiment. Hence, it is possible to arbitrarily set such section period;

6. The present embodiment does not refer to melody keys. However, it is possible to additionally install the melody keys so that melody performance can be played;

7. Returning destination of sequencer repeat performance is not limited to the head portion thereof;

8. In the present embodiment, the function of break switch is shared by the S/S switch and I/F switch. However, it is possible to further provide the on/off switches exclusively used for the break function.

Therefore, the preferred embodiment described herein is illustrative and not restrictive, the scope of the invention being indicated by the appended claims and all variations which come within the meaning of the claims are intended to be embraced therein.

What is claimed is:

1. A sequencer unit for an electronic musical instrument comprising:

(a) rhythm tone generating means for generating a rhythm tone which progresses from an initial state;

(b) start commanding means for giving a start command to said rhythm tone generating means to thereby start generating said rhythm tone;

(c) stop commanding means for giving a stop command to said rhythm tone generating means to thereby stop generating said rhythm tone; and (d) rhythm tone control means for controlling said rhythm tone generating means so as (a) not to generate said rhythm tone but to continue progression of the rhythm from the time said stop command is given until the time said start command is given, and thereafter resume generation of the rhythm tone according to its progression, when said start command is given before a predetermined time has passed since said stop command has been given, and (b) to generate said rhythm tone from the initial state when said start command is given after said predetermined time has passed since said stop command has been given.

2. A sequencer unit for an electronic musical instrument comprising:

(a) memory means containing a plurality of memories each storing performance data;

(b) select means for selecting one of said plurality of memories;

(c) means for generating a tempo clock;

(d) reading means for sequentially reading out said performance data from said memory means based on said tempo clock; and (e) reading control means for changing over from readout of a first memory currently being read out to readout of a second memory to be next read out, wherein said first memory is changed over to said second memory at a timing dependent upon when said select means selects said second memory.

3. A sequencer unit for an electronic musical instrument according to claim 2, wherein said reading control means immediately changes over from said first memory when said select means generates a select signal within a predetermined section of a particular bar of a musical performance associated with performance data being read out by said reading means, and wherein said reading control means changes over from said first memory at a head timing of a next bar after the particular bar when said select means generates said select signal after said predetermined section of said particular bar.

4. A sequencer unit for an electronic musical instrument comprising:

(a) memory means for storing performance data;
(b) writing means for writing said performance data into said memory means;
(c) means for generating a tempo clock; and
(d) reading means for sequentially reading out said performance data from said memory means based on said tempo clock, said reading means reading out said performance data in accordance with a predetermined order corresponding to an end timing for writing said performance data into said memory means when the last of said performance data written in said memory means is located in the middle of a bar, wherein a non-tone period corresponding to the time between said end timing for writing said performance data into said memory means and the end of said bar is eliminated in a reproduction state so that performance date is continuously and repeatedly read out from said memory means.

5. A sequencer unit for an electronic musical instrument according to claim 4, wherein said reading means immediately returns to the head data of the immediately preceding bar, when said performance data read by said reading means end within a predetermined section of said bar, and wherein when said performance data end after said predetermined section of said bar, said reading means reads the performance data and maintains the end value of said performance data until the end of the bar and then returns to the head data of the immediately receding bar for reading.

6. A sequencer unit for an electronic musical instrument according to claim 4, wherein said reading means returns to data of a section of the immediately preceding bar after reading data written within a predetermined section and before said end timing of performance data as data of said predetermined section so that said reading means repeatedly reads out said performance data of a predetermined range.

7. An electronic musical instrument comprising:

(a) memory means for storing performance data;
(b) means for generating a tempo clock;
(c) reading means for sequentially reading out said performance data from said memory means based on said tempo clock;
(d) musical tone generating means for generating a musical tone in response to performance data read out by said reading means;
(e) first switch means for changing a performance state form an automatic performance state to a non-automatic performance state;
(f) second switch means for re-starting said automatic performance in said non-automatic performance state; and
(g) control means for inhibiting a generation of musical tone, without stopping a generation of said tempo clock and a counting operation of said tempo clock when said control means detects that said first switch means is operated, and wherein said control means allows said generation of musical tone when said control means detects that said second switch means is operated.

8. An electronic musical instrument according to claim 7, wherein said automatic performance is an automatic rhythm performance.

9. An electronic musical instrument according to claim 7, wherein said automatic performance is an automatic accompaniment.

10. An electronic musical instrument according to claim 7, wherein said control means inhibits and allows a reading operation of said performance data.

11. An electronic musical instrument according to any one of claims 8 to 10, wherein said first switch means is a stop switch for stopping said automatic performance, said control means inhibits said generation of musical tone when said control means detects that said stop switch is operated, said control means stopping said automatic performance after a counting operation of said tempo clock counts an end value corresponding to an end timing of a predetermined bar when said second switch means is not operated until said end value is counted.

12. An electronic musical instrument according to any one of claims 8 to 10, wherein said second switch means is a pattern switch for changing a pattern of said automatic performance.

13. An electronic musical instrument according to any one of claims 8 to 10, wherein said first switch means and said second switch means are one and the same.

14. A sequencer unit for an electronic musical instrument comprising:

(a) first memory means for storing chord data;
(b) second memory means for storing a plurality of accompaniment patterns including an ending pattern;
(c) means for selecting one of said accompaniment patterns;
(d) means for generating a tempo clock;
(e) reading means for sequentially reading out stored data from said first and second memory means based on said tempo clock; and
(f) accompaniment data generating means for generating and outputting accompaniment data based on said chord data and said accompaniment pattern, said accompaniment data generating means generating and outputting said accompaniment data based on a limited range of chord data when said ending pattern is selected.

15. A sequencer unit for an electronic musical instrument according to claim 14, wherein said accompaniment data generating means maintains said chord data within said limited range at a timing corresponding to a timing when said accompaniment pattern is changed over to said ending pattern in the case where said ending pattern is selected.

16. A sequencer unit for an electronic musical instrument according to claim 14 or 15, wherein said accompaniment data generating means immediately changes over said accompaniment pattern to said ending pattern when said ending pattern is selected in a former part of a first bar, and said accompaniment data generating means changes over said accompaniment pattern to said ending pattern at a head timing of a second bar when said ending pattern is selected in a latter part of said first bar.

17. An electronic musical instrument comprising:

(a) input means for inputting a music performance;

(b) control means for controlling an automatic performance based on a performance on said input means;

(c) a tempo generator for generating a clock pulse corresponding to a predetermined tempo;

(d) a sequencer memory including a plurality of sequencer areas each storing specific performance data which are generated in accordance with a performance of said input means in advance, said performance data being written in and read from each sequencer area in synchronism with said clock pulse;

(e) register means including a plurality of registers each writing and reading out specific data under control of said control means; and (f) switching means including a plurality of switches each controlling an automatic performance which is played based on said performance data stored in said sequencer memory.

18. An electronic musical instrument according to claim 17, wherein one of predetermined modes is selected by operating said switching means, said predetermined modes including a normal mode wherein said control means allows performance on said input means without playing an automatic performance of rhythm or accompaniment; a synchro standby mode wherein said control means allows an automatic rhythm performance to be started in synchronism with said input means performance; a run mode wherein said control means allows said input means performance with playing said automatic rhythm performance; a break mode wherein said control means breaks said automatic rhythm performance and then allows said keyboard performance; and an ending mode wherein rhythm and accompaniment patterns of the last two bars corresponding to the ending of a musical tune being performed on said input means are automatically performed and then said automatic performance is stopped.

19. An electronic musical instrument according to claim 17, wherein said switching means includes a first switch having functions of starting and stopping said automatic performance, a second switch having functions of starting said automatic performance in synchronism with said input means performance and starting an ending performance, a third switch having functions of starting and automatic performances in accordance with a predetermined intro pattern and fill-in pattern, and a fourth switch for selecting one of said sequencer areas and starting said automatic performance in accordance with said performance data of a selected sequencer area.

20. An electronic musical instrument according to claim 17, wherein said sequencer memory is constituted by random access memory (RAM) having a plurality of storing areas each corresponding to one of said sequencer areas.

* * * * *